US005853936A

United States Patent [19]

Segi et al.

[11] Patent Number: 5,853,936

[45] Date of Patent: Dec. 29, 1998

[54] LIGHT RECEIVING MEMBER, SUBSTRATE FOR SAID LIGHT RECEIVING MEMBER, AND ELECTROPHOTOGRAPHIC APPARATUS HAVING SAID LIGHT RECEIVING MEMBER

[75] Inventors: Yoshio Segi; Hiroyuki Katagiri; Yasuyoshi Takai; Hideaki Matsuoka, all of Nara; Toshiyuki Ehara, Yokohama, all of Japan

[73] Assignee: Canon Kabushiki Kaisha, Tokyo, Japan

[21] Appl. No.: 814,588

[22] Filed: Mar. 10, 1997

[30] Foreign Application Priority Data

Mar. 8, 1996 [JP] Japan ..... 8-051715
Feb. 28, 1997 [JP] Japan ..... 9-045829

[51] Int. Cl.[6] ..... G03G 5/10

[52] U.S. Cl. ..... 430/69; 430/84; 399/165

[58] Field of Search ..... 430/58, 59, 128, 430/69, 84; 399/165

[56] References Cited

U.S. PATENT DOCUMENTS 5,582,947 12/1996 Shirai et al. ..... 430/128

FOREIGN PATENT DOCUMENTS 60-168156 8/1985 Japan .
60-178457 9/1985 Japan .
60-225854 11/1985 Japan .
61-231561 10/1986 Japan .

*Primary Examiner*—John Goodrow
*Attorney, Agent, or Firm*—Fitzpatrick, Cella, Harper & Scinto

[57] ABSTRACT

An electrophotographic light receiving member comprising a substrate in a cylindrical form and a light receiving layer formed on said substrate, wherein said substrate has (i) a portion with an enlarged bore at least on the side of an end portion of said substrate and (ii) a portion in a tapered form situated next to and outside said portion (i). An electrophotographic apparatus provided with said electrophotographic light receiving member.

82 Claims, 6 Drawing Sheets

LIGHT RECEIVING MEMBER, SUBSTRATE FOR SAID LIGHT RECEIVING MEMBER, AND ELECTROPHOTOGRAPHIC APPARATUS HAVING SAID LIGHT RECEIVING MEMBER

BACKGROUND OF THE INVENTION

1. Field of the Invention

The present invention relates to a light receiving member which is sensitive to electromagnetic waves such as light (which herein means in a broader sense such radiation such as ultraviolet rays, visible rays, infrared rays, and X-rays) such as an electrophotographic light receiving member, a substrate for said light receiving member, and an electrophotographic apparatus having said light receiving member.

2. Related Background Art

As the semiconductor material for use in semiconductor devices, electrophotographic light receiving members, image input line sensors, image pickup devices, photovoltaic devices, other various electronic elements, and optical elements, there have been proposed a number of non-single crystalline deposited films comprising a non-single crystalline material such as an amorphous silicon material compensated by hydrogen atoms (H) or/and halogen atoms (X) such as fluorine or chlorine atoms (this amorphous silicon material will be hereinafter referred to as a-Si(H,X)), and a number of crystalline deposited film such as a diamond thin film. Some of these deposited films have been put into practical use. It is known that these deposited films may be formed by means of a plasma CVD process in which a given raw material gas is decomposed by way of glow discharge by means of a D.C. or high frequency power or a microwave power whereby a deposited film is formed on an appropriate substrate such as a glass substrate, a quartz substrate, a heat resistant synthetic resin substrate, a stainless steel substrate or an aluminum substrate. There are known various plasma CVD apparatus suitable for practicing the plasma CVD film-forming process.

As an example of such plasma CVD apparatus, there can be mentioned a high frequency plasma CVD apparatus suitable for producing an electrophotographic light receiving member.

FIG. 1 is a schematic diagram illustrating an example of such plasma CVD apparatus.

In FIG. 1, numeral reference 2100 indicates a deposition apparatus, reference numeral 2200 a raw material gas supply system, reference numeral 2111 a reaction chamber, reference numeral 2112 a cylindrical substrate on which a deposited film is to be formed, reference numeral 2113 a cylindrical substrate holder having a heater 2113' installed therein for heating said substrate, reference numeral 2114 a raw material gas feed pipe, reference numeral 2115 a high frequency power matching box, reference numeral 2116 a gas piping, reference numeral 2117 a leak valve, reference numeral 2118 a main valve, reference 2119 a vacuum gauge, each of reference numerals 2211–2216 a mass flow controller, each of reference numerals 2221–2226 a raw material gas reservoir, each of reference numerals 2231–2236 a valve for one of said raw material gas reservoirs, each of reference numerals 2241–2246 an inlet valve, each of reference numerals 2251–2256 an exit valve, reference numeral 2260 a sub-valve, and each of reference numerals 2261–2266 a pressure controller.

The plasma CVD apparatus shown in FIG. 1 can be roughly divided into the deposition apparatus 2100, raw material supply system 2200, and an exhaust device (not shown) for depressurizing the inside of the reaction chamber 2111. As is apparent from FIG. 1, the reaction chamber 2111 in the deposition apparatus 2100 contains the cylindrical substrate 2112 supported on the cylindrical substrate holder 2113 having the heater 2113' installed therein and and the raw material gas feed pipe 2114 (usually having a plurality of gas release holes capable uniformly supplying a raw material gas toward the cylindrical substrate 2112). The high frequency power matching box 2115 is electrically coupled to the reaction chamber 2111.

The raw material gas supply system 2200 comprises the gas reservoirs 2221–2226 for raw material gases such as $SiH_4$, $GeH_4$, $H_2$, $B_2H_6$, $PH_3$, and the like; and the valves 2231–2236, the inlet valves 2241–2246, the exit valves 2251–2256 and the mass flow controllers 2211–2216 respectively corresponding to one of the gas reservoirs 2221–2226. The raw material gas supply system 2200 is designed such that the raw material gas from each gas reservoir can be introduced into the reaction chamber 2111 through the sub-valve 2260 and the raw material gas feed pipe 2114.

The formation of a deposited film using the plasma CVD apparatus shown in FIG. 1 may be conducted, for example, in the following manner.

A cylindrical substrate on which a deposited film is to be formed is placed on the substrate holder 2113 in the reaction chamber 2111. The inside of the reaction chamber 2111 is evacuated to a desired vacuum degree by means of the exhaust device comprising a vacuum pump, for example (not shown in the figure). The temperature of the cylindrical substrate is controlled to a desired temperature in the range of 20° to 450° C. by means of the heater 2113'.

Particularly, prior to the entrance of raw material gases into the reaction chamber 2111, it is confirmed that the valves 2231–2236 for the gas reservoirs 2221–2226 and the leak valve 2117 of the reaction chamber 2111 are closed and that the inlet valves 2241–2246, the exit valves 2251–2256, and the sub-valve 2260 are opened. Then, the main valve 2118 is first opened to evacuate the inside of the reaction chamber 2111 and the inside of the gas piping 2116 by the vacuum pump (not shown). Then, upon observing that the reading on the vacuum gauge 2119 becomes a predetermined vacuum degree of, for example, about 5×10 Torr, the sub-valve 2260 and the exit valves 2251–2256 are closed.

Thereafter, the valves 2231–2236 are opened to introduce raw material gases from the gas reservoirs 2221–2226, and the pressures of the respective gases are adjusted to 2 $Kg/cm^2$ by means of the pressure controllers 2261–2266. Then, the inlet valves 2241–2246 are gradually opened to introduce the respective gases in the mass flow controllers 2211–2216.

After completing the preparation for the film formation as described above, the formation of a layer as a light receiving layer is conducted as follows. After the temperature of the cylindrical substrate 2112 becomes stable at a desired temperature, one or more of the exit valves 2251–2256 (which are necessary to be used for the formation of the layer) and the sub-valve 2260 are gradually opened to introduce one or more given raw material gases (which are required for the formation of the layer) from one or more of the gas reservoirs 2221–2226 into the reaction chamber 2111 through the gas feed pipe 2114. The flow rate of each raw material gas is controlled to a predetermined value by means of one or more of the mass flow controllers 2211–2216 involved. In this case, the gaseous pressure (inner pressure) of the reaction chamber 2111 is adjusted to a predetermined value of less than 1 Torr by regulating the opening of the main valve 2118 while observing the reading on the vacuum gauge 2119. After all the flow rates of the raw material gases and the inner pressure of the reaction chamber 2111 becomes stable, a high frequency power (having an oscillation frequency of 13.56 MHz) of a desired wattage from a high frequency power source (not shown in the figure) is applied into the reaction chamber 2111 through the matching box 2115 to cause glow discharge in the raw material gases introduced therein, where the raw material gases are decomposed to cause the formation of a deposited film containing, for example, silicon atoms as a matrix on the cylindrical substrate 2112. After the deposited film is formed at a desired thickness on the cylindrical substrate 2112, the application of the high frequency power is suspended and the exit valves are closed to suspend the introduction of the raw material gases into the reaction chamber. By this, the formation of the deposited film as the light receiving layer is completed. If necessary, by repeating the above film-forming procedures several times, there can be formed a light receiving layer having a multi-layered structure.

All the exit valves other than those required for upon forming the respective layers are, of course closed. Further, if necessary, upon forming the respective layers, the inside of the system is once evacuated to a high vacuum degree as required by closing the exit valves 2251–2256 while opening the sub-valve 2260 and fully opening the main valve 2118 in order to prevent the gases used for the formation of the previous layer to be left in the reaction chamber 2111 and also in the gas pipe ways.

In this way, there can be formed a desired as deposited film such as an a-Si deposited film as a light receiving layer on a cylindrical substrate. By this procedure, there can be produced an electrophotographic light receiving member (or an electrophotographic light receiving drum).

The electrophotographic light receiving member thus produced is used by installing it in an appropriate electrophotographic apparatus.

FIG. 2 is a schematic diagram of illustrating the constitution of an example of such electrophotographic apparatus provided with an electrophotographic light receiving member.

In FIG. 2, reference numeral 1101 indicates a photosensitive member in an cylindrical form which comprises the foregoing electrophotographic light receiving member, reference numeral 1102 a main corona charger, reference numeral 1103 an electrostatic latent image-forming mechanism, reference numeral 1104 a development mechanism, reference numeral 1105 a transfer sheet (such as paper, OHP sheet, or the like) feeding mechanism, reference numeral 1106 a charger comprising a transfer charger (a) and a separating charger (b), reference numeral 1107 a cleaning mechanism comprising a magnet roller and a cleaning blade 1121, reference numeral 1108 a transfer sheet conveying mechanism, reference numeral 1109 a charge elimination lamp, reference numeral 1110 a light source for irradiating light to an original, reference numeral 1111 an original table made of glass or the like, reference numeral 1112 an original, each of reference numerals 1113, 1114, 1115 and 1116 a mirror, reference numeral 1117 a lens system containing a filter, reference numeral 1122 a pair of feed timing rollers, reference numeral 1124 a fixing mechanism, each of reference numerals 1125 and 1127 a charge elimination brush, reference numeral 1126 a reversing passage of a switchback system, reference numeral 1128 a sheet feeding zone, and reference numeral 1129 a sheet feeding roller.

In the electrophotographic apparatus shown in FIG. 2, as shown in FIG. 2, the electrophotographic light receiving member 1101 in a cylindrical form and having a light receiving layer (hereinafter referred to as light receiving member) rotates in the direction indicated by an arrow mark. Near the light receiving member 1101, there are provided the main corona charger 1102, the electrostatic latent image-forming mechanism 1103, the development mechanism 1104, the transfer sheet feeding mechanism 1105, the transfer charger 1106(*a*), the separating charger 1106(*b*), the transfer sheet conveying mechanism 1108, the cleaning mechanism 1107 (comprising the magnet roller 1107 and the cleaning blade 1121), and the charge elimination lamp 1109.

The image-forming process in the electrophotographic apparatus is conducted, for example, as will be described in the following. The surface of the light receiving member 1101 is uniformly charged by the main corona charger 1102 to which a voltage of +600 to +800 V is impressed. Then, the original 1112 to be reproduced which is placed on the original table 1111 made of glass is irradiated with light from the light source 1110 through the glass original table 1111, and the resulting reflected light is projected through mirrors 1113, 1114 and 1115, the lens system 1117 containing the lens 1118, and the mirror 1116 onto the surface of the light receiving member 1101 to form an electrostatic latent image corresponding to the original 1112 on the surface of the light receiving member 1101. The electrostatic latent image formed on the surface of the light receiving member 1101 is developed with toner (for example, having an negative polarity) supplied by the development mechanism 1104 to form a toner image on the surface of the light receiving member 1101. (Herein, in the case of negative charging, there is used toner having a positive polarity.) A transfer sheet P is supplied through the transfer sheet feeding mechanism 1105 comprising a transfer sheet guide and the pair of feed timing rollers 1122 so that the transfer sheet P is brought into contact with the surface of the light receiving member 1101, and corona charging is effected with the polarity different to that of the toner from the rear of the transfer sheet P by the transfer charger 1106(*a*) to which a voltage of +1 to +5 kV is impressed, whereby the toner image is transferred onto the transfer sheet P. The transfer sheet P having the toner image transferred thereon is electrostatically removed from the light receiving member 1101 by the charge-removing action of the separating charger 1106(*b*) where an A.C. voltage of 1.2 to 1.4 kvp-p and with 300 to 600 Hz is impressed, and it is conveyed by the transfer sheet conveying mechanism 1108 to the fixing mechanism 1124, where the transfer sheet P is taken out outside the apparatus.

The residual toner on the surface of the light receiving member 1101 is removed by the cleaning mechanism 1107 (comprising the magnet roller 1107 and the cleaning blade 1121) upon arrival at the cleaning mechanism, and the removed toner is stored in a storing box (not shown). Thereafter, the light receiving member 1101 thus cleaned is entirely exposed to light by the charge elimination lamp 1109 to erase the residual charge and is recycled.

Incidentally, in the case of an electrophotographic light receiving member in a cylindrical form comprising an a-Si film as a light receiving layer formed on a drum-like shaped substrate, the a-Si light receiving layer excels in electrophotographic characteristics. However, in order for the a-Si light receiving layer to have more improved electrophotographic characteristic, the temperature of the drum-like shaped substrate upon forming the a-Si light receiving layer thereon is maintained at a temperature which is higher than room temperature, i.e., usually at a temperature of about 150° C. or more. In this case, phenomena are liable to occur such that the difference between the thermal expansion coefficient of the drum-like shaped substrate and that of the a-Si light receiving layer is enlarged, and that since the a-Si light receiving layer is necessary to be relatively thickened, the a-Si light receiving layer formed has a relatively large stress. In this respect, a problem is liable to occur in that opposite end portions of the drum-like shaped substrate are deformed. Particularly, due to the above described large difference in terms of the thermal expansion coefficient and the above-described large stress of the a-Si light receiving layer, the opposite end portions of the drum-like shaped substrate are liable to shrink such that the diameter of the drum-like shaped substrate is deformed so as to gradually decrease in a direction toward each opposite end portion of the drum-like shaped substrate.

In order to prevent the occurrence these problems, there are several proposals.

For instance, Japanese Patent Publication No. 27948/1994 discloses a manner of supplementing a deformation occurred at each opposite end portion of a drum-like shaped substrate for an photoconductive member (an electrophotographic light receiving member) by making the ratio between the minimum thickness at each opposite end portion and the maximum thickness at a central portion of the drum-like shaped substrate to be a specific value.

Besides this, Japanese Unexamined Patent Publication No. 337534/1994 discloses a manner wherein each opposite end portion of a drum-like shaped substrate for an electrophotographic light receiving member is designed to have a first and second tapered faces for supplementing a deformation occurred at the opposite end portion of the drum-like shaped substrate, and the drum-like shaped substrate is designed to have a flat exterior surface for improving the contact precision of the drum-like shaped substrate with the roller of the development mechanism in the electrophotographic apparatus and also for improving the occurrence of a defective image due to layer peeling.

According to these methods, the deformation problem occurring at each opposite end portion of the drum-like shaped substrate can be improved at a certain extent so that it has an improved correspondence to the toner image development by the development mechanism of the electrophotographic apparatus. However, these procedures are still not sufficiently satisfactory. Particularly, in the case of an amorphous silicon (a-Si) series electrophotographic photosensitive member (that is, an a-si series electrophotographic light receiving member) in a cylindrical form in which a drum-like shaped substrate is used (this photosensitive member will be hereinafter referred to as photosensitive drum), it is desirable to provide an improved photosensitive drum capable of forming a high quality image with no uneven density image and wherein said photosensitive drum is efficiently produced at a reasonable production cost by thinning the drum-like shaped substrate. In order to attain such photosensitive drum capable of forming a high quality image with no uneven density image and which can be produced at a reasonable production cost, for the drum-like shaped substrate, it is necessary to have a further improved correspondence to the toner image development and in addition to this, it is necessary to eliminate unevenness in an electrostatic latent image due to a change in the distance of the charger of the electrophotographic apparatus, which occurs due to eccentricity of the drum-like shaped substrate in the electrophotographic apparatus.

In order to attain this purpose, it is required to develop a technique capable of desirably supplementing the deformation which occurs at each opposite end portion of the drum-like shaped substrate wherein, the drum-like shaped substrate is designed to have an improved fit with an instrument (flange) in order to install it in the electrophotographic apparatus so that it can be engaged with the flange with an improved precision fit. The drum-like shaped substrate is designed such that it is not off-center in the electrophotographic apparatus while constantly maintaining the distance to the charger at a given value whereby the occurrence of an uneven density image is prevented. However, these requirements are have not satisfactorily fulfilled at the present time.

SUMMARY OF THE INVENTION

A principal object of the present invention is to provide a drum-like shaped substrate for an electrophotographic light receiving member, which is capable of desirably supplementing the deformation occurring at each of the opposite end portions thereof and has an improved precision fit with a counterbore portion of a flange (a fixing instrument) in order to install it in an electrophotrographic apparatus such that it can be engaged with the flange with an improved precision, an electrophotographic light receiving member provided with said drum-like shaped substrate which is free of the occurrence of an uneven density image, and an electrophotographic apparatus provided with said electrophotographic light receiving member.

Another object of the present invention is to provide an electrophotographic light receiving member comprising a drum-like shaped substrate having a desired inner diameter and a light receiving layer formed on said drum-like shaped substrate, wherein said drum-like shaped substrate has a counterbore portion whose inner diameter is enlarged on the side of at least an end portion of said drum-like shaped substrate and a tapered portion situated next to and outside said counterbore portion, and an electrophotographic apparatus provided with said electrophotographic light receiving member.

A further object of the present invention is to provide an electrophotographic light receiving member comprising a drum-like shaped substrate having a desired inner diameter, a light receiving layer formed on said drum-like shaped substrate, and a fixing member (comprising a flange) equipped in concert with said drum-like shaped substrate on the side of at least an end portion of said drum-like shaped substrate for sustaining said drum-like shaped substrate, wherein said drum-like shaped substrate has (a) a portion whose inner diameter is enlarged on the side of at least an end portion of said drum-like shaped substrate and (b) a tapered portion having a thickness which is gradually thinned than that of said portion (a) in direction toward said end portion of said drum-like shaped substrate, and said fixing member is provided in contact with said portion (a).

A further object of the present invention is to provide a substrate for an electrophotographic light receiving member, wherein said substrate comprising a drum-like shaped substrate having a desired inner diameter, wherein said drum-like shaped substrate has (a) a portion whose inner diameter is enlarged on the side of at least an end portion of said drum-like shaped substrate and (b) a tapered portion situated next to and outside said portion (a).

A further object of the present invention is to provide an electrophotographic apparatus comprising a light receiving member comprising a drum-like shaped substrate having a desired inner diameter, a light receiving layer formed on said drum-like shaped substrate, and a fixing member equipped in concert with said drum-like shaped substrate on the side of at least an end portion of said drum-like shaped substrate for sustaining said drum-like shaped substrate wherein said light receiving member is made to be capable of being rotated by means of said fixing member, and also comprising at least a charging means, a developing means and a transferring means which are provided about said light receiving member, and further comprising a transporting mechanism for a transfer sheet (for example, a paper or OHP sheet) onto which a developer (for example, a toner) is transferred and an exposure means, wherein said drum-like shaped substrate as (a) a portion whose inner diameter is enlarged on the side of at least an end portion of said drum-like shaped substrate and (b) a tapered portion having a thickness which is gradually thinned than that of said portion (a) in direction toward said end portion of said drum-like shaped substrate, and said fixing member is provided in contact with said portion (a).

DETAILED DESCRIPTION OF THE INVENTION AND THE PREFERRED EMBODIMENTS

The present inventors conducted extensive studies through experiments in order to overcome the foregoing problems found in the prior art and in order to attain the above objects of the present invention. The present invention has been accomplished based on the following findings obtained as a result of the extensive studies by the present inventors.

Figure 3:
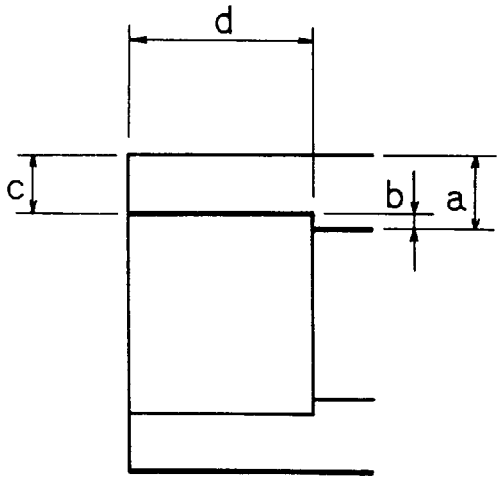
FIGS. 3 through 6 are schematic cross-sectional views respectively for explaining an example of the configuration of an end portion of a drum-like shaped substrate.

In general, for a drum-like shaped substrate used as a substrate in an electrophotographic light receiving member in a cylindrical form (an electrophographic light receiving drum in other words), in order for the drum-like shaped substrate to be fixed to the inside of a fabrication apparatus for producing said electropotographic light receiving member in a cylindrical form (hereinafter simply referred to as light receiving drum) by forming a light receiving layer (comprising, for example, an a-Si film) on the drum-like shaped substrate or in order for a fixing instrument (a flange) to be engaged with the light receiving drum in mesh for installing the light receiving drum in an electrophotographic apparatus (or an electrophotographic copying machine), each of the opposite end portions of the drum-like shaped substrate (this will be hereinafter referred to as "an end portion of the drum-like shaped substrate") is processed to have such a counterbore portion as shown in FIG. 3.

Figure 7:
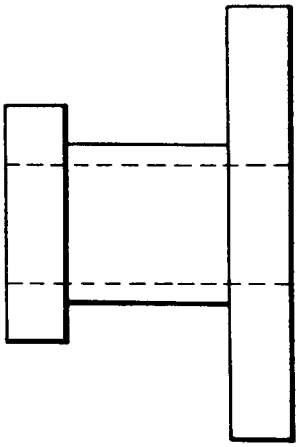
FIGS. 7 and 8 are schematic lateral views respectively for explaining an example of a fixing member.
Figure 8:
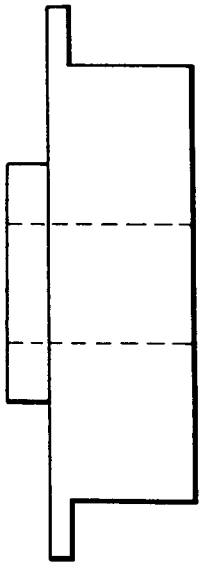

In the case where the fixing instrument (the flange) is fixed to the counterbore portion of the light receiving drum in order to install the light receiving drum in the electrophotographic apparatus, as said fixing instrument, there is used a fixing instruments (a flange) having an appropriate configuration. Specifically, for instance, there can be used a combination with a fixing instrument (a flange) having such a configuration as shown in FIG. 7 or 8 depending upon the retaining position. In any case, the dimensional precision for any area of the counterbore portion to be contacted with any of these fixing instruments (flanges) is important. Especially, the dimensional precision of the plane (d) in FIG. 3 is the most important. The processing of this counterbore portion may be conducted by cutting the inner face of an end portion of the drum-like shaped substrate, where the thickness of the end portion whose inner face having been cut is thinner than that of the central portion of the drum-like shaped substrate.

Figure 4:
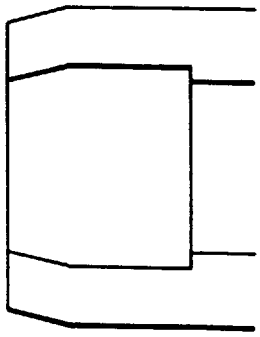

Because of this, after a deposited film is formed on such drum-like shaped substrate, the drum-like shaped substrate's end portion whose thickness being thinned is liable to deform such that said end portion is narrowed in terms of the inner diameter as shown in FIG. 4 and as a result, a problem is liable to entail such that the fixing instrument (the flange) (in order to install the drum-like shaped substrate as an electrophotographic light receiving drum in the electrophotographic apparatus) cannot be desirably fixed to the end portion of the drum-like shaped substrate because its inner diameter is small. When the drum-like shaped substrate is of a thickness of about 5 mm, the deformation magnitude at its end portion is relatively small and therefore, no substantial problem will be occurred. However, in the case where the drum-like shaped substrate is of a thin thickness of, for example, less than 3 mm, it is apparently problematic.

In order to eliminate the foregoing problem relating to the fitting of the fixing instrument (the flange), the present inventors conducted experiments as follows. On a drum-like shaped substrate of 3 mm in thickness and whose inner face having a counterbore portion at each outer end portion thereof, a deposited film as a light receiving layer was formed. And the dimension of the end portion of each counterbore portion was measured. Then, when a fixing instrument (a flange) having the configuration shown in FIG. 7 and having a dimension corresponding to the dimension of the counterbore portion was engaged with the counterbore portion of the drum-like shaped substrate, it was found that a backlash tends to occur between the fixing instrument (the flange) and the counterbore portion of the drum-like shaped substrate. And when the drum-like shaped substrate having the light receiving layer thereon was installed in an electrophotographic apparatus, followed by subjecting to electrophotographic image-forming process, it was found that the drum-like substrate is liable to off-center whereby causing the occurrence of an uneven density image.

Separately, a fixing instrument (a flange) having the configuration shown in FIG. 8 and having a dimension corresponding to the dimension of the counterbore portion was engaged with the counterbore portion of the drum-like shaped substrate. In this case, the occurrence of the backlash was slight. But when the drum-like shaped substrate having the light receiving layer thereon was installed in an electrophotographic apparatus, followed by subjecting to electrophotographic image-forming process, it was found that the drum-like substrate is liable to off-center whereby causing the occurrence of an uneven density image also in this case. The dimension of the counterbore portion in this case was again examined. As a result, there were obtained such findings as will be described in the following. There is a dimensional difference between its end portion and its inner part, where the dimension of the end portion is smaller than that before the formation of the deposited film and the dimension of the inner part is substantially the same as that before the formation of the deposited film. Particularly, the counterbore portion is not entirely deformed but only a certain part of the counterbore portion on the end portion side is deformed to have a narrowed inner diameter, where the inner part of the counterbore portion is substantially free of such deformation problem.

Based on these findings, in the case of a drum-like shaped metal substrate or an electrophotographic light receiving member in a cylindrical form comprising a drum-like shaped metal substrate and a light receiving layer (comprising, for example, an amorphous material containing silicon atoms as a matrix) formed on said substrate, there was obtained a finding that for a counterbore portion formed at the inner face of the drum-like shaped substrate, it is important to be designed to have an outer end portion shaped in a tapered form.

As a result of having conducted further experimental studies by the present inventors, there was obtained a finding that the deformation at the end portion of the counterbore portion formed at the inner face of the drum-like shaped substrate is related to the thickness of the end portion of the counterbore portion and the length of the counterbore portion. Based on this finding, there was obtained a further finding that by designing the counterbore portion formed at the inner face of the drum-like shaped metal substrate to have an end portion shaped in a tapered form having a specific value in terms of the thickness and also in terms of the length, there are provided advantages in that the occurrence of the deformation at the end portion of the drum-like shaped substrate can be desirably supplemented, and the fittingness precision for the fixing instrument (the flange) to be engaged with the counterbore portion of the electrophotographic light receiving drum in mesh in order to install the electrophotographic light receiving drum in the electrophotographic apparatus is improved, where the occurrence of a defective image accompanied by an uneven density image is effectively prevented.

Particularly, there was obtained a finding that a desirable result is provided when the ratio between the minimum thickness (e) of the tapered end portion of the counterbore portion and the maximum thickness (c) of the central portion of the counterbore portion is made to be in the range of 0.47 to 0.96.

There was obtained another finding that a more desirable result is provided when the ratio between the length (f) of the tapered end portion of the counterbore portion and the entire length (d) of the counterbore portion is made to be in the range of 0.3 to 0.6.

There was obtained a further finding that a further improved result is provided when the ratio between the aforesaid thickness (c) and the thickness (a) of the central portion of the drum-like shaped metal substrate is made to be in the range of 0.5 to 0.8. In this case, when said thickness (a) of the central portion of the drum-like shaped metal substrate is made to be 3 mm or less, a significant result is provided.

And in any case, it was found that for the metal constituent of the drum-like shaped metal substrate, there is no particular limitation, but it is desired to be aluminum or aluminum alloy.

In addition, as a result of having conducted further experimental studies by the present inventors, there were obtained such findings as will be described in the following. For an electrophotographic light receiving drum in which a drum-like shaped substrate whose inner face portion having a counterbore portion at each end portion thereof is used, when a fixing instrument (a flange) is engaged with the counterbore portion of the light receiving drum in mesh in order to install the light receiving drum in an electrophotographic apparatus, the face of the counterbore portion which enables to maintain a highly precise fittingness for the fixing instrument (the flange) engaged with the counterbore portion is present at a specific position of the counterbore portion. Particularly, for an electrophotographic light receiving member in a cylindrical form comprising a drum-like shaped metal substrate whose inner face having a counterbore portion at each end portion thereof and a light receiving layer (comprising, for example, an amorphous material containing silicon atoms as a matrix) formed on said substrate, the counterbore portion is desired to be designed such that it has an outer end portion shaped in a tapered form and has a face capable of enabling to maintain a highly precise fittingness for the instrument (the flange) engaged with the counterbore portion at its specific position. Specifically, the ratio between the length (f) of the tapered end portion of the counterbore portion and the total length (d) of the counterbore portion is desired to be in the range of 0.3 to 0.6.

For the foregoing specific position at which the foregoing face is provided, it is desired to be other than the tapered end portion (f). Specifically in this respect, the ratio between the minimum thickness (e) of the tapered end portion of the counterbore portion and the maximum thickness (c) of the central portion of the counterbore portion is desired to be in the range of 0.47 to 0.96. In addition, the ratio between the thickness (c) of the counterbore portion and the thickness (a) of the central portion of the drum-like shaped substrate is desired to be in the range of 0.5 to 0.8.

When the thickness (a) of the central portion of the drum-like shaped substrate is 0.3 mm or less, a pronounced advantage is provided.

Separately, the present inventors conducted extensive studies through experiments while focusing on the fixing instrument (the flange) used for installing an electrophotographic light receiving drum (comprising a drum-like shaped metal substrate whose inner face having a counterbore portion at each end portion thereof and a light receiving layer formed thereon) in an electrophotographic apparatus. As a result, there was obtained a finding that in the case where the light receiving drum is installed in the electrophotographic apparatus by using a fixing instrument (a flange) having a specific configuration, there can be effectively obtained a high quality image which is free of unevenness in image density. Particularly, the counterbore portion provided at the inner face of the drum-like shaped metal substrate is designed to have an outer end portion in a tapered form. In addition to this, the fittingness precision for the fixing instrument (the flange) (for retaining the drum-like shaped metal substrate) engaged with the counterbore portion in mesh is made to be maintained at a specific position of the counterbore portion.

In this case, the ratio between the length (f) of the tapered end portion of the counterbore portion (of the drum-like shaped metal substrate) and the total length (d) of the counterbore portion is desired to be in the range of 0.3 to 0.6. And the ratio between the minimum thickness (e) of the tapered end portion of the counterbore portion and the maximum thickness (c) of the central portion of the counterbore portion is desired to be in the range of 0.47 to 0.96. In addition, the ratio between the thickness (c) of the counterbore portion and the thickness (a) of the central portion of the drum-like shaped substrate is desired to be in the range of 0.5 to 0.8. For the foregoing specific position of the counterbore portion, it is desired to be other than the tapered end portion (f).

For the fixing instrument (the flange) to be engaged with the counterbore portion of the drum-like shaped metal substrate, it is desired to be configured as will be described below for other face of the counterbore portion than the tapered end portion (f) thereof. Particularly, the fixing instrument (the flange) is desired to be configured such that it has a portion (X) capable of maintaining a desirable fittingness precision with the counterbore portion, a portion (Y) having a face to be contacted with the end portion (e) of the counterbore portion and a non-contacting portion (Z) between said portions (X) and (Y) so as to satisfy the following equation Z<X<Y.

In this case, when the thickness (a) of the central portion of the drum-like shaped metal substrate is 3 mm or less, a pronounced advantage is also provided.

Figure 5:
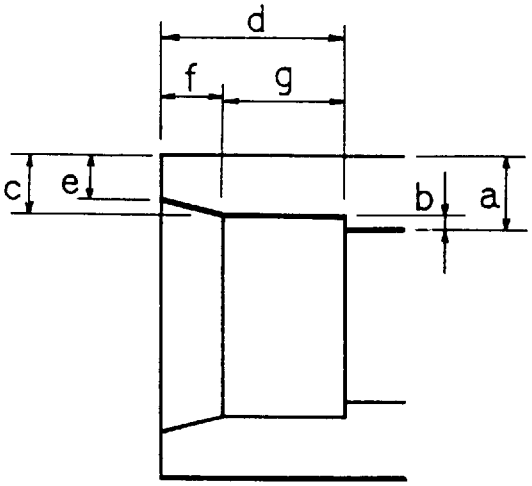
Figure 6:
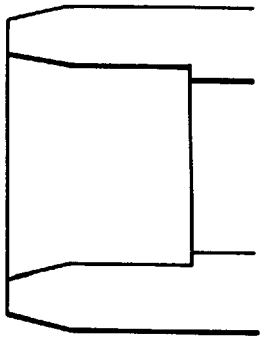

Now, FIGS. 5 and 6 are schematic cross-sectional views respectively illustrating an example of the configuration of an end portion of a drum-like shaped metal substrate (for an electrophotographic light receiving member in a cylindrical form) whose inner face having a counterbore portion with an outer end portion shaped in a tapered form at each end potion of the inner face in the present invention. Particularly, FIG. 5 is a schematic cross-sectional view illustrating an example of the configuration of the end portion of the drum-like shaped metal substrate prior to forming a deposited film as a light receiving layer on said substrate. FIG. 6 is a schematic cross-sectional view illustrating an example of the configuration of the end portion of the drum-like shaped metal substrate after a deposited film as a light receiving layer has been formed on said substrate.

Figure 11:
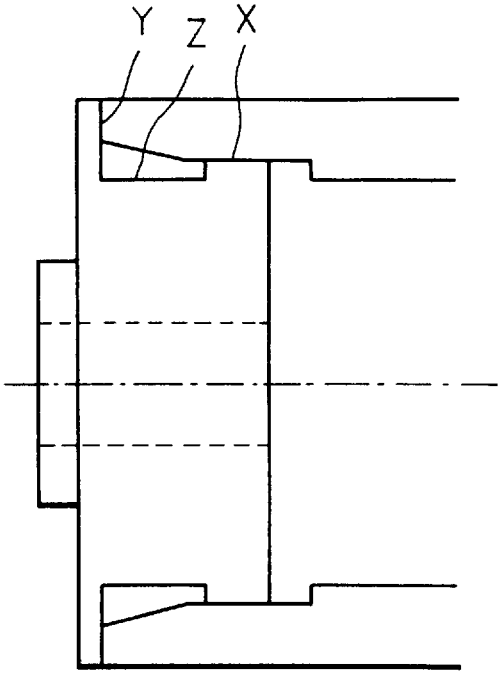
Figure 12:
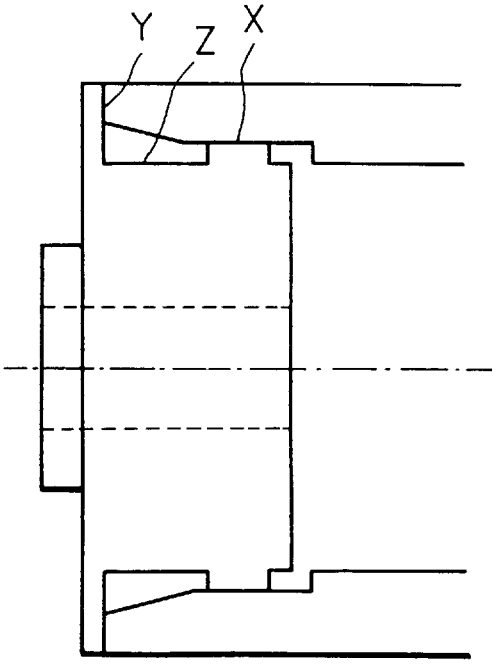

And FIGS. 11 and 12 are schematic cross-sectional views respectively illustrating an example of each of the configuration and the retaining position of a fixing instrument (a flange) for retaining a drum-like shaped metal substrate (for an electrophotographic light receiving member in a cylindrical form) whose inner face having a counterbore portion with an outer end portion shaped in a tapered form at each end potion of the inner face in the present invention.

Incidentally, when a deposited film (for instance, an a-Si deposited film) as a light receiving layer is formed on a drum-like shaped metal substrate (having a cylindrical inner space) by means of a plasma CVD process, the opposite end portions of said substrate tend to shrink such that they are deformed to decrease the inner diameter of the substrate in a direction toward each of the opposite end portions, due to the difference between the two thermal expansion coefficients or/and the stress of the deposited film.

However, according to the present invention, this .problem can be effectively prevented from occurring. In the present invention, for the drum-like shaped substrate used in the production of an electrophotographic light receiving drum, the inner face of the drum-like shaped metal substrate is previously designed to have a specific counterbore portion having an outer end portion in a tapered form at each end portion thereof in which the minimum thickness (e) of the tapered end portion and the maximum thickness (c) of the central portion of the counterbore portion are made to be extents which are greater than the change rate in which the inner diameter of the drum-like shaped metal substrate is decreased and which cause no negative influence to not only the function of the drum-like shaped metal substrate but also the image-forming characteristics of a light receiving layer formed on the drum-like shaped metal substrate, and the length (f) of the tapered end portion is made to be an extent which is greater than the change rate in which each opposite end portion of the drum-like shaped metal substrate is deformed and which cause no negative influence to not only the function of the drum-like shaped metal substrate but also the image-forming characteristics of a light receiving layer formed on the drum-like shaped metal substrate.

Figure 9:
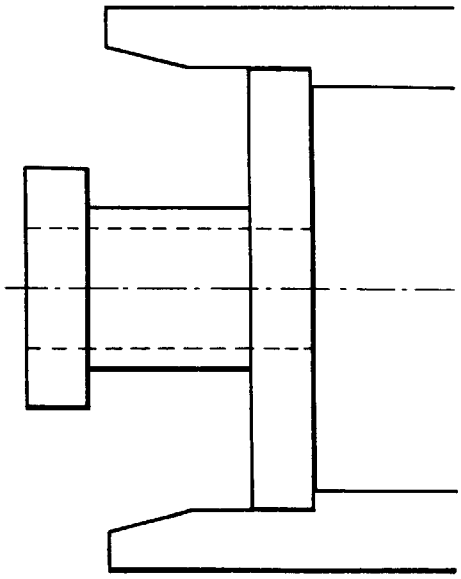
FIGS. 9 through 12 are schematic cross-sectional views respectively illustrating an end portion of a drum-like shaped substrate in which a fixing member is equipped in mesh.
Figure 10:
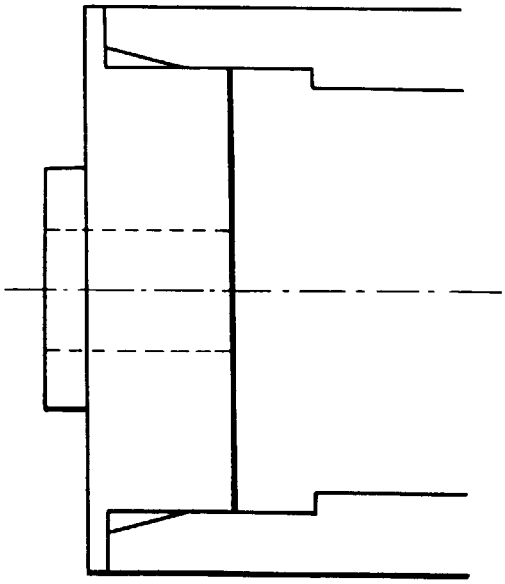

The part (excluding the tapered end portion (f)) of the counterbore portion is always maintained in a linear form because it is never deformed even after the formation of the deposited film, for the foregoing reason. But for the face (f) of the tapered end portion of the counterbore portion, it has a tendency in that the inner diameter is decreased due to the stress of the deposited film. However, because the length (f) of the tapered end portion is greater than the change rate in which each opposite end portion of the drum-like shaped metal substrate is deformed as above described, the dimension of the tapered end portion is still maintained to be greater even after the formation of the deposited film, in comparison with the dimension of the part (excluding the tapered end portion) of the counterbore portion. Hence, even in the case where after the formation of the deposited film, the dimension of the face (f) of the tapered end portion of the counterbore portion is greater than that of the remaining part other than the face (f) or even in the case where the length of the face (f) of the tapered end portion is greater than the change rate in which the inner diameter of the drum-like shaped metal substrate is decreased, by retaining the fixing instrument (the flange) for retaining an electrophotographic light receiving drum by a specific portion, i.e. other portion than the face (f) of the tapered end portion of the counterbore portion, there can be attained desirable caulking between the two members in a linear area with no occurrence of deformation so that a desirable fittingness precision is maintained between the two members. By this, a fixing instrument (a flange) having the configuration shown in FIG. 7 or 8 is desirably engaged with the counterbore portion of the drum-like shaped metal substrate in mesh as shown in FIG. 9 or 10 with an improved fittingness precision. This enables to stably obtain a high quality image which is substantially free of unevenness in image density in an electrophotographic apparatus Herein, for the fixing instrument (the flange) for retaining an electrophotographic light receiving drum comprising a drum-like shaped metal substrate whose inner face having the foregoing specific counterbore portion at each end portion thereof, it is desired to have a contact width of 1 mm or more against other face of the counterbore portion than the face (f) of the tapered end portion. For the configuration thereof, any appropriate configuration other than those shown in FIGS. 7 and 8 may be adopted. Alternatively, any combination of these configurations may be adopted. And for the configurations shown in FIGS. 7 and 8, their extended side end portions may be the same or different in terms of the shape. In addition, these are effective against a change in the end portion deformation rate due to a variation in the thicknesses of respective deposited films which are continuously formed and also against a deformation rate difference between the opposite end portions of the drum-like shaped metal substrate. Further, for the tapered end portion (f) of the counterbore portion, it is corresponding a part where the substrate is deformed due to the stress of a deposited film formed thereon. For the boundary portion between the tapered end portion (f) of the counterbore portion and other portion of the counterbore portion, it becomes to be a starting point for the substrate to be deformed due to the processing precision for the substrate before the formation of the deposited film or the stress of a deposited film formed on the substrate. Because the caulking precision is attained for the fixing instrument (the flange) for retaining the electrophotographic light receiving drum as above described, no problem is entailed. However, this caulking precision may be more improved by a manner wherein for the configuration of the fixing instrument (the flange) for retaining the electrophotographic light receiving drum, as shown in FIG. 11 or 12, its portion (X) contacted with a position (which is substantially free of deformation) the counterbore portion with a dimension capable of maintaining a desirable caulking precision and the portion (Z) which is corresponding to an area for the counterbore portion to be deformed due to the stress of a deposited film formed is made to be a non-contact portion (having a diameter which is smaller than that of the portion (X)) which is not contacted with said area of the counterbore portion By this, when the electrophographic light receiving drum thus configured for the drum-like shaped metal substrate thereof is installed in an electrophotographic apparatus, a more improved high quality image which is free of unevenness in image density is stably provided.

For the portion (Y) of the fixing instrument (the flange), it is desired to be designed to have a configuration (having a diameter which is greater than that of the portion (X)) which is corresponding to the length (d) of the counterbore portion and which can be desirably contacted with the end portion of the counterbore portion.

In any case, the fixing instrument (the flange) for retaining the electrophotographic light receiving drum is desired to be designed such that it starts contacting with a side which is inner by more than 0.1 mm from the boundary between the tapered end portion (f) and other portion of the counterbore portion and it has a contacting width of 1 mm or more. For the configuration of this, those mentioned in FIGS. 11 and 12 may be adopted. Besides, a combination of these configuration may be adopted. Alternatively, those mentioned in FIGS. 7 and 8 or a combination of these may be also adopted.

The deformation at the opposite end portions of the drum-like shaped metal substrate can be desirably supplemented by providing a counterbore portion having a specific tapered end portion at each of the opposite end portion of the drum-like shaped metal substrate as above described, and in addition to this, the caulking precision for the fixing instrument (the flange) (for installing the drum-like shaped metal substrate as an electrophotographic light receiving drum in an electrophotographic apparatus) to be engaged with the counterbore portion of the drum-like shaped can be desirably improved. Particularly, an electrophotographic light receiving drum comprising a drum-like shaped metal substrate whose inner face having the foregoing counterbore portion having a specific outer end portion in a tapered form at each end portion thereof and a light receiving layer (comprising, for example, an a-Si material) formed on said substrate can be desirably engaged with the fixing instrument (the flange) with an improved caulking precision and because of this, when the electrophotographic light receiving drum is installed in an electrophotographic apparatus and it is subjected to image formation, a high quality image which is free of unevenness in image density is stably provided.

The above advantages are significant when the thickness (a) of the central portion of the drum-like shaped metal substrate is made to be 3 mm or less and the ratio between the thickness (c) of the counterbore portion and said thickness (a) is made to be in the range of 0.5 to 0.8. Even when the thickness (a) of the central portion of the drum-like shaped metal substrate is made to be beyond 3 mm or less than 5 mm, an adequate result is provided.

The drum-like shaped metal substrate used in the present invention is desired to be constituted by an aluminum material or an aluminum alloy material. In the case of using any of these materials as the constituent of the drum-like shaped metal substrate, there can be readily produced a desirable drum-like shaped metal substrate (whose inner face having the foregoing counterbore portion with a tapered outer end portion) having a substantially complete round form and a desirable surface flatness at a precision as desired. In addition, the temperature control in the production of said drum-like shaped metal substrate can be readily conducted. And to use these material is advantageous also in economical view point.

The drum-like shaped metal substrate used in the present invention is in a cylindrical form. The surface thereof may be a flat surface or irregular surface. The surface state of the drum-like shaped metal substrate should be determined so that a desired electrophotographic light receiving member is obtained.

For instance, in the case of conducting image formation using coherent light such as laser beams, the substrate may be designed to have an uneven surface in order to prevent the occurrence of a so-called interference fringe pattern being apt to appear in the image formed. The formation of such uneven surface may be conducted in accordance with the conventional manner described in any of Japanese Unexamined Patent Publications Nos. 168156/1985, 178457/1985 and 225854/1985.

Alternatively, in order to effectively prevent the occurrence of such defective image due to the interference fringe pattern, the surface of the substrate may be provided with irregularities comprising a plurality of spherical dimples whose sizes are smaller than the resolution required for the electrophotographic light receiving member. The formation of such irregularities at the surface of the substrate may be conducted by the conventional manner described, for example, in Japanese Unexamined Patent Publication No. 231561/1986.

Figure 1:
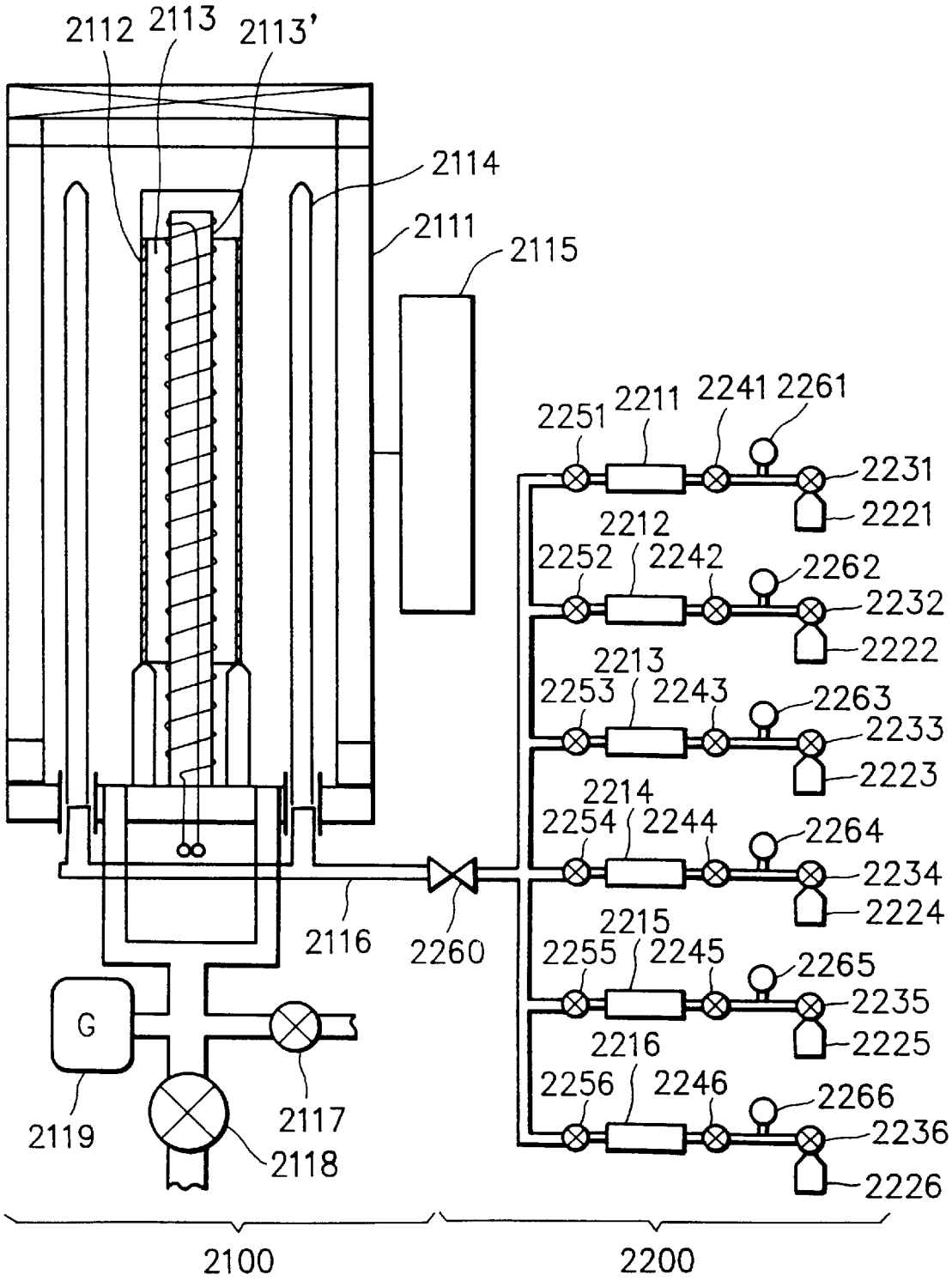
FIG. 1 is a schematic diagram illustrating an example of a plasma CVD film-forming apparatus.

Now, in order to form, for instance, an a-Si deposited film as a light receiving layer by the glow discharge decomposition process using the plasma CVD apparatus shown in FIG. 1, for instance, a gaseous raw material capable supplying silicon atoms (Si) and a gaseous raw material capable of supplying hydrogen atoms (H) or/and a gaseous raw material capable of supplying halogen atoms (X) are introduced into the reaction chamber containing a desired substrate, wherein glow discharge is caused to thereby form an a-Si:H,X deposited film on said substrate.

Such Si-supplying gaseous raw material can include gaseous or gasifiable silicon hydrides such as silanes. Specific examples are $SiH_4$, $Si_2H_6$, $Si_3H_8$, $Si_4H_{10}$, and the like. Of these, $SiH_4$ and $Si_2H_6$ are particularly preferred in view of the easy layer forming work and the good efficiency for the supply of Si.

In order to structurally introducing hydrogen atoms (H) into a deposited film formed while controlling its amount to be incorporated therein so that said deposited film has a desired property, typically, a mixture of any of the foregoing silicon hydrides or other gaseous hydrogen-containing silicon compound, and $H_2$ gas or/and He gas is introduced into the reaction chamber at a predetermined mixing ratio to form said deposited film on the substrate in the same manner as in the above. These gaseous materials may be separately introduced into the reaction chamber at predetermined respective flow rates.

The gaseous raw material capable of supplying halogen atoms (X) can include gaseous or gasifiable halogen compounds such as gaseous halogen, halides, and interhalogen compounds, and gaseous or gasifiable halogen-substituted silane derivatives. Besides these, gaseous or gasifiable halogen-substituted silicon hydrides are also usable. Specific preferable examples of such halogen compound are fluorine gas ($F_2$), BrF, ClF, $ClF_3$, $BrF_3$, $BrF_5$, $IF_3$, and IF Specific preferable examples of such halogen-substituted silane derivative are $SiF_4$, $Si_2F_6$, and the like.

To control the amount of hydrogen atoms (H) or/and halogen atoms (X) contained in a deposited film formed may be conducted by properly controlling one or more of the related parameters upon film formation such as the substrate temperature, the amount of the raw material capable of supplying H or/and X to be introduced into the reaction chamber, the discharging power, and the like.

It is possible for a deposited film formed as a light receiving layer to contain atoms of an appropriate conductivity-controlling element as required. Atoms of such conductivity-controlling element may be contained either in the entire layer region or in a given partial layer region of the light receiving layer in a uniformly distributed state or in an unevenly distributed state in the thickness direction while taking into account their amount contained, depending upon the situation involved.

The conductivity-controlling element can include so-called impurities used in the field of semiconductor such as elements capable of imparting p-type conductivity which belong to group IIIB of the periodic table (hereinafter referred to as group IIIB element) and elements capable of imparting n-type conductivity which belong to group VB of the periodic table (hereinafter referred to as group VB element) Specific examples of the group IIIB element are B, Al, Ga, In, and Tl, of these, B, Al, and Ga being the most preferable. Specific examples of the group VB element are P, As, Sb, and Bi, of these, P and As being the most preferable.

For amount of the conductivity-controlling atoms to be incorporated into the light receiving layer, in general, it is preferably $1\times10^{-2}$ to $1\times10^{4}$ atomic ppm, more preferably $5\times10^{-2}$ to $5\times10^{3}$ atomic ppm, most preferably $1\times10^{-1}$ to $1\times10^{3}$ atomic ppm.

In order to structurally introduce atoms of a given group IIIB or VB element into the light receiving layer, a gaseous raw material capable of supplying atoms of the group IIIB or VB element is introduced into the reaction chamber together with a given film-forming gaseous raw material. The raw material capable of supplying the atoms of the group IIIB or VB element can include those which are gaseous under condition with room temperature and normal pressure or are easily gasifiable under layer-forming conditions.

Specific examples of the raw material capable of supplying the atoms of the group IIIB element are boron hydrides such as $B_2H_6$, $B_4H_{10}$, $B_5H_9$, $B_5H_{11}$, $B_6H_{10}$, $B_6H_{12}$, and $B_6H_{14}$, and boron halides such as $BF_3$, $BCl_3$, and $BBr_3$. Besides these, $AlCl_3$, $GaCl_3$, $Ga(CH_3)_3$, $InCl_3$, and $TlCl_3$ are also usable.

Specific examples of the raw material capable of supplying the atoms of the group VB element are phosphorous hydrides such as $PH_3$ and $P_2H_4$, and phosphorous halides such as $PH_4I$, $PF_3$, $PF_5$, $PCl_3$, $PCl_5$, $PBr_3$, $PBr_5$, and $PI_3$. Besides these, $AsH_3$, $AsF_3$, $AsCl_3$, $AsBr_3$, $AsF_5$, $SbH_3$, $SbF_3$, $SbF_5$, $SbCl_3$, $SbCl_5$, $BiH_3$, $BiCl_3$, and $BiBr_3$ are also usable.

If necessary, it is possible for any of these raw materials capable of supplying the atoms of the group IIIB or VB element to be diluted with $H_2$ gas or He gas upon introducing into the reaction chamber.

In order to form a deposited film having a desired property as a light receiving layer by the glow discharge decomposition process, the related film-forming parameters such as the mixing ratio between a given Si-supplying gaseous raw material and a dilution gas used, the gas pressure (or the inner pressure) in the reaction chamber, the glow discharging power, and the substrate temperature are necessary properly controlled.

The flow rate of $H_2$ gas or/and He gas used as the dilution gas should be properly determined depending upon the design of a light receiving layer to be formed. However, in general, it is preferably in the range of 1 to 20 times, more preferably in the range of 3 to 15 times, most preferably 5 to 10 times, respectively against the flow rate of the Si-supplying gaseous raw material.

The gas pressure in the reaction chamber should be also properly determined depending upon the design of a light receiving layer to be formed.

However, in general, it is preferably in the range of $1\times10^{-4}$ to 10 Torr, more preferably in the range of $5\times10^{-4}$ to 5 Torr, most preferably in the range of $1\times10^{-3}$ to 1 Torr.

The discharging power should be also properly determined depending upon the design of a light receiving layer to be formed.

However, in general, in terms of the discharging power against the flow rate of the Si-supplying gaseous raw material, it is preferably in the range of 0.1 to 7 times, more preferably in the range of 0.5 to 6 times, most preferably in the range of 0.7 to 5 times.

The substrate temperature should be also properly determined depending upon the design of a light receiving layer to be formed.

However, in general, it is desired to be in the range of 200° to 350° C.

However, the actual conditions for forming a desired deposited film as a light receiving layer such as the substrate temperature, the gas pressure in the reaction chamber, and the discharging power usually cannot be determined with ease independent of each other. Accordingly, the conditions optimum to the formation of the deposited film are desirably determined based on relative and organic relationships for forming the deposited film having desired properties.

The present invention will be be detailed with reference to examples, which are only for illustrative purposes and are not intended to restrict the scope of the present invention.

REFERENCE EXAMPLE 1

There were provided five cylindrical substrates (drum-like shaped substrates) made of aluminum of 358 mm in length and 80 mm in outer diameter and having a polished surface.

Each of the five drum-like shaped substrates was subjected to processing to form a counterbore portion of the configuration shown in FIG. 3 at the inner face of each of the opposite end sides thereof under conditions in that the the total length (d) of the counterbore portion is made to be 18 mm, the ratio between the thickness (c) of the counterbore portion and the thickness (a) of the central portion of the substrate is made to be 0.72 and the thickness (a) of the central portion of the substrate is varied in the range of from 2.0 to 5.0 mm By this, there were obtained five substrate samples 1-a to 1-e as shown in Table 2.

Each of the resultant five substrate samples was positioned on the substrate holder 2113 (comprising a cylindrical holder made of Al) of the plasma CVD apparatus shown in FIG. 1.

Then, in accordance with the foregoing film-forming procedures using the plasma CVD apparatus shown in FIG. 1 and under film-forming conditions shown shown in Table 1, there were formed a charge injection inhibition layer, a photoconductive layer, and a surface layer in the named order on the polished surface of the substrate sample.

By this, there were obtained five electrophotographic light receiving drum samples.

EVALUATION

For each of the resultant five electrophotographic light receiving drum samples, evaluation was conducted with respect to (1) fittingness of a fixing instrument comprising a flange (this will be referred to as flange fittingness) and (2) unevenness in image density in the following manner.

The evaluated results obtained are collectively shown in Table 2.

(1) Evaluation of the flange fittingness:

There were provided (i) a fixing instrument (a flange) having the configuration shown in FIG. 7 for one counterbore portion and (ii) a fixing instrument (a flange) having the configuration shown in FIG. 8 respectively of a caulking tolerance h8 and for installing an electrophotographic light receiving drum in an electrophotographic apparatus.

Using these two fixing instruments, caulking test was conducted by engaging one fixing instrument with one of the opposite counterbore portions and the other fixing instrument with the remaining counterbore portion, where the flange fittingness of the counterbore portions with these fixing instruments was examined. This test was conducted for each of the electrophotographic light receiving drum samples.

The examined results are collectively shown in Table 2 based on the following criteria.

O: a case where the flange fittingness is good enough,

Δ: a case where the flange fittingness is not so good but practically acceptable, and X: a case where the flange fittingness is inferior and therefore, practically problematic.

(2) Evaluation of the unevenness in image density:

In this evaluation, in order to install each electrophotographic light receiving drum sample in an electrophotographic apparatus, there were used two different fixing instruments (flanges) one having the configuration shown in FIG. 7 and of caulking tolerance h8 and the other having the configuration shown in FIG. 8 and of caulking tolerance h8.

Particularly, for each of the electrophotographic light receiving drum samples, there were used two different fixing instruments (flanges), i.e., a fixing instrument (a flange) having the configuration shown in FIG. 7 and which had been adjusted so as to correspond the single bore diameter of one of the opposite counterbore portions thereof with a caulking tolerance h8 and a fixing instrument (a flange) having the configuration shown in FIG. 8 and which had been adjusted so as to correspond the single bore diameter of the remaining counterbore portion with a caulking tolerance h8.

Figure 2:
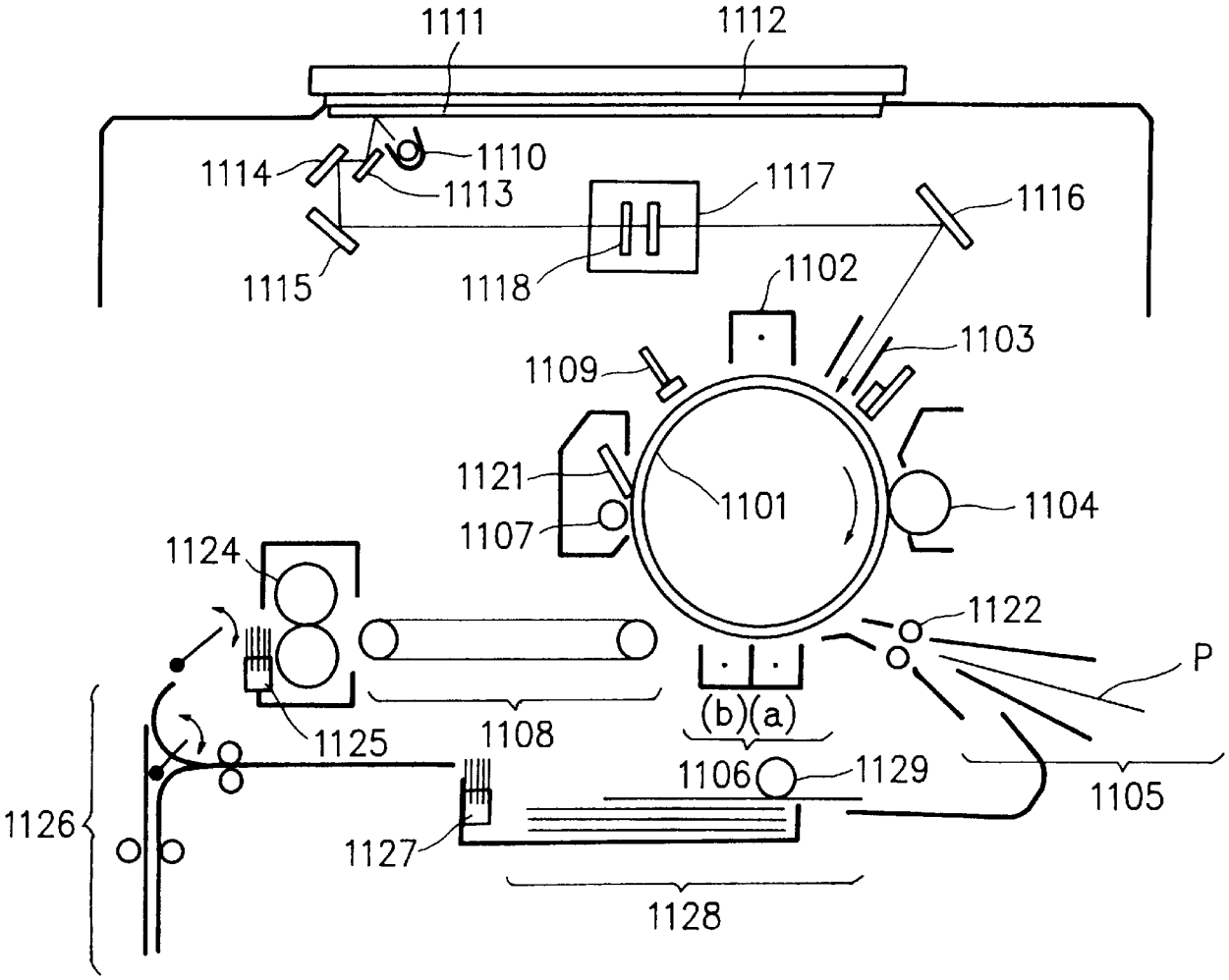
FIG. 2 is a schematic diagram illustrating an example of an electrophotographic apparatus.

Each electrophotographic light receiving drum sample whose opposite counterbore portions having been engaged with the two fixing instruments (the flanges) in mesh was installed an electrophotographic apparatus NP 6750 having the constitution shown in FIG. 2 and which has been modified to be usable for experimental purposes (produced by Canon Kabushiki Kaisba), wherein using a halftone test chart FY9-9042 (produced by CANON Kabushiki Kaisha) in which the entire area comprises a halftone image as an original, copying shot for an A3-sized paper was conducted under ordinary image-forming conditions to obtain a copied image.

For the resultant copied image, thick density areas and thin density areas were selected. And the optical densities of these areas were measured by means of a Macbeth densitometer (produced by Macbeth Company). Based on the measured optical density values, there were obtained (a) a mean value among the measured optical density values for the thick density areas and (b) a mean value among the measured optical density values for the thin density areas. Then, there was obtained a ratio in terms of percentage between the two mean values. The resultant was made to be an unevenness in image density.

This evaluation was conducted for each of the five electrophotographic light receiving drum samples.

The evaluated results obtained are collectively shown in Table 2 based on the following criteria.

⊙: a case where the unevenness in image density is less than 10% (good enough),

O: a case where the unevenness in image density is in the range of more than 10% to less than 15% (good), Δ: a case where the unevenness in image density in the range of more than 15% to less than 30% (not so good but practically acceptable), and X: a case where the unevenness in image density is more than 30% (practically problematic).

Figure 13:
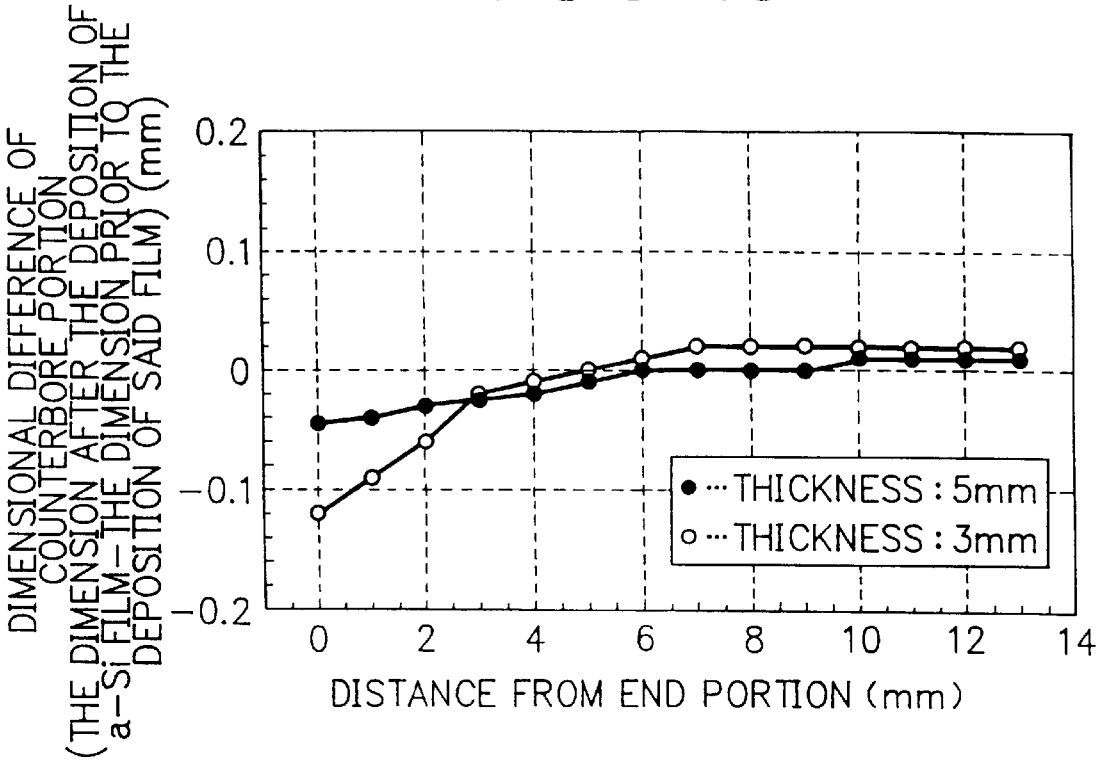
FIGS. 13 and 14 are graphs respectively showing interrelations between a dimentional difference of the counterbore portion (the dimension after the deposition of an a-Si film—the dimension prior to the deposition of said a-Si film) and the distance from an end portion.

Separately, for each of the electrophotographic light receiving drum samples based on the substrate samples 1-a and 1-c, the inside diameter of one of the opposite counterbore portions was measured at a plurality of positions before and after the film deposition. The measured results are graphically shown in FIG. 13 in terms of relationships between the dimensional difference (the dimension after the deposition of the a-Si film—the dimension prior to the deposition of said film) and the distance from the outermost end side of the counterbore portion.

Based on the results shown in Table 2, the following facts are understood. When the thickness (a) of the central portion of the drum-like shaped substrate is 3.0 mm or less, the deformation rate at each of the opposite end portions of the drum-like shaped substrate is great and because of this, the fixing instrument (the flange) is difficult to caulk with the counterbore portion with a desirable fittingness precision. When a given fixing member (a given flange) corresponding to the dimension of the counterbore portion after the film deposition, there is provided a desirable copied image which is good enough in therms of evenness in image density as long as the thickness (a) of the central portion of the drum-like shaped substrate is beyond 3.0 mmm. Particularly, this situation indicates that as apparent from the results shown in FIG. 13, the thinner the thickness (c) of the counterbore portion provided at each end portion of the drum-like shaped substrate is, the greater the deformation rate of the end portion of the drum-like substrate is and wherein problems will be entail with respect to caulking of the fixing instrument (the flange) and density evenness of an image reproduced.

EXAMPLE 1

There were provided a plurality of cylindrical substrates (drum-like shaped substrates) made of aluminum of 358 mm in length and 80 mm in outer diameter and having a polished surface.

Each drum-like shaped substrate was subjected to processing to form a counterbore portion (having a tapered outer end portion) of the configuration shown in FIG. 5 at the inner face of each of the opposite end sides thereof under conditions in that the the total length (d) of the counterbore portion is made to be 18 mm; the ratio between the length (f) of the tapered outer end portion of the counterbore portion and the total length (d) of the counterbore portion is made to be 0.3; the the ratio between the thickness (c) of the counterbore portion and the thickness (a) of the central portion of the substrate is made to be 0.72; the ratio between the minimum thickness (e) of the tapered outer end portion of the counterbore portion and the maximum thickness (c) of the central portion of the counterbore portion is varied in the range of 0.37 to 0.99; and the thickness (a) of the central portion of the substrate is varied in the range of from 2.0 to 5.0 mm. By this, there were obtained a plurality of substrate samples 2-a to 2-i as shown in Table 3.

Each of the resultant substrate samples was positioned on the substrate holder 2113 (comprising a cylindrical holder made of Al) of the plasma CVD apparatus shown in FIG. 1.

Then, in accordance with the foregoing film-forming procedures using the plasma CVD apparatus shown in FIG. 1 and under film-forming conditions shown in Table 1, there were formed a charge injection inhibition layer, a photoconductive layer, and a surface layer in the named order on the polished surface of the substrate sample.

By this, there were obtained a plurality of electrophotographic light receiving drum samples.

EVALUATION

For each of the resultant electrophotographic light receiving drum samples, evaluation was conducted with respect to (1) fittingness of a fixing instrument comprising a flange (this will be referred to as flange fittingness), (2) unevenness in image density, and (3) layer peeling in the following manner. In addition, total evaluation (4) was conducted based on evaluated results for these three evaluation items (1) to (3).

The evaluated results obtained are collectively shown in Tables 3 and 4.

(1) Evaluation of the flange fittingness:

There were provided a fixing instrument (a flange) having the configuration shown in FIG. 7 for one counterbore portion and another fixing instrument (a flange) having the configuration shown in FIG. 8 respectively of a caulking tolerance h8 and for installing an electrophotographic light receiving drum in an electrophotographic apparatus.

Using these two fixing instruments, caulking test was conducted by engaging one fixing instrument with one of the opposite counterbore portions and the other fixing instrument with the remaining counterbore portion, where the flange fittingness of the counterbore portions with these fixing instruments was examined. This test was conducted for each of the electrophotographic light receiving drum samples.

The examined results are collectively shown in Table 3 based on the following criteria.

O: a case where the flange fittingness is good enough,

Δ: a case where the flange fittingness is not so good but practically acceptable, and X: a case where the flange fittingness is inferior and therefore, practically problematic.

(2) Evaluation of the unevenness in image density:

In this evaluation, in order to install each electrophotographic light receiving drum sample in an electrophotographic apparatus, there were used two different fixing instruments (flanges) one having the configuration shown in FIG. 7 and of caulking tolerance h8 and the other having the configuration shown in FIG. 7 and of caulking tolerance h8.

Particularly, for each of the electrophotographic light receiving drum samples, there were used two different fixing instruments (flanges), i.e., a fixing instrument (a flange) having the configuration shown in FIG. 7 and which had been adjusted so as to correspond the single bore diameter of one of the opposite counterbore portions thereof with a caulking tolerance h8 and a fixing instrument (a flange) having the configuration shown in FIG. 8 and which had been adjusted so as to correspond the single bore diameter of the remaining counterbore portion with a caulking tolerance h8.

Each electrophotographic light receiving drum sample whose opposite counterbore portions having been engaged with the two fixing instruments (the flanges) in mesh was installed an electrophotographic apparatus NP 6750 having the constitution shown in FIG. 2 and which has been modified to be usable for experimental purposes (produced by Canon Kabushiki Kaisha), wherein using a halftone test chart FY9-9042 (produced by CANON Kabushiki Kaisha) in which the entire area comprises a halftone image as an original, copying shot for an A3-sized paper was conducted under ordinary image-forming conditions to obtain a copied image. For the resultant copied image, thick density areas and thin density areas were selected. And the optical densities of these areas were measured by means of a Macbeth densitometer (produced by Macbeth Company). Based on the measured optical density values, there were obtained (a) a mean value among the measured optical density values for the thick density areas and (b) a mean value among the measured optical density values for the thin density areas. Then, there was obtained a ratio in terms of percentage between the two mean values. The resultant was made to be an unevenness in image density.

This evaluation was conducted for each of the resultant electrophotographic light receiving drum samples.

The evaluated results obtained are collectively shown in Table 3 based on the following criteria.

⊚: a case where the unevenness in image density is less than 10% (good enough),

O: a case where the unevenness in image density is in the range of more than 10% to less than 15% (good), Δ: a case where the unevenness in image density in the range of more than 15% to less than 30% (not so good but practically acceptable), and X: a case where the unevenness in image density is more than 30% (practically problematic).

(3) Evaluation of the layer peeling:

For each of the electrophotographic light receiving drums, examination was conducted with respect to layer peeling at its opposite end portions by way of visual inspection.

The examined results are collectively shown in Table 4 based on the following criteria.

O: a case where no layer peeling is present

Δ: a case where layer peeling of less than 1 mm is present but practically acceptable, and X: a case where layer peeling of more than 1 mm is present and seemingly problematic in practice.

(4) Total evaluation:

This evaluation was conducted based on the following criteria.

⊚: a case where the evaluated results of the above evaluation items (1) to (3) are good enough, O: a case where the evaluated results of the above evaluation items (1) to (3) are good, Δ: a case where the evaluated results of the above evaluation items (1) to (3) are not good but practically acceptable, X: a case where the evaluated results of the above evaluation items (1) to (3) are seemingly problematic in practice.

The evaluated results obtained are collectively shown in Table 4.

COMPARATIVE EXAMPLE 1

The procedures of Example 1 were repeated, except that the configuration of the counterbore portion was changed to the linear configuration shown FIG. 3, to thereby obtain a plurality of substrate samples and a plurality of electrophotographic light receiving drum samples.

For the resultant electrophotographic light receiving drum samples, evaluation was conducted with respect to (1) flange fittingness, (2) unevenness in image density, (3) layer peeling, and (4) total evaluation in the same manner as in Example 1. The evaluated results obtained are collectively shown in Tables 3 and 4.

Based on the results shown in Tables 3 and 4, the following facts are understood. When the thickness (c) of the central portion of the drum-like shaped substrate is 3 mm or less, by making the ratio between the minimum thickness (e) of the tapered outer end portion of the counterbore portion and the maximum thickness (c) of the central portion of the counterbore portion to be 0.96 or less, there can be attained an improvement in the flange fittingness. However, when the ratio between the minimum thickness (e) of the tapered outer end portion of the counterbore portion and the maximum thickness (c) of the central portion of the counterbore portion to be less than 0.47, layer peeling is liable to occur at the end portion of the electrophotographic light receiving drum. Therefore, to use a drum-like shaped metal substrate whose inner face having a counterbore portion with a specific tapered outer end portion of 0.47 to 0.96 in the ratio between the minimum thickness (e) of the tapered outer end portion of the counterbore portion and the maximum thickness (c) of the central portion of the counterbore portion provides pronounced advantages in that the end portion of the counterbore portion is effectively supplemented as shown in FIG. 4, a remarkable improvement is attained in the flange fittingness, and the production of a high quality electrophptographic light receiving drum which is free of layer peeling and which provides a high quality image which is free of unevenness in image density is enabled.

Separately, for each of the electrophotographic light receiving drum sample based on the substrate sample 2-g-c obtained in Example 1 and the electrophotographic light receiving drum sample based on the substrate sample 1-c obtained in Comparative Example 1, the inside diameter of one of the opposite counterbore portions was measured at a plurality of positions before and after the film deposition. The measured results are graphically shown in FIG. 14 in terms of relationships between the dimensional difference (the dimension after the deposition of the a-Si film—the dimension prior to the deposition of said film) and the distance from the outermost end side of the counterbore portion.

EXAMPLE 2

There were provided a plurality of cylindrical substrates (drum-like shaped substrates) made of aluminum of 358 mm in length, 80 mm in outer diameter and 3 mm in thickness and having a polished surface.

Each drum-like shaped substrate was subjected to processing to form a counterbore portion (having a tapered outer end portion) of the configuration shown in FIG. 5 at the inner face of each of the opposite end sides thereof under conditions in that the ratio between the minimum thickness (e) of the tapered outer end portion of the counterbore portion and the maximum thickness (c) of the central portion of the counterbore portion is made to be 0.96; the ratio between the thickness (c) of the counterbore portion and the thickness (a) of the central portion of the substrate is made to be 0.72; the ratio between the length (f) of the tapered outer end portion of the counterbore portion and the total length (d) of the counterbore portion is varied in the range of 0.2 to 0.8; and the total length (d) of the counterbore portion is varied in the range of 5 to 23 mm.

By this, there were obtained a plurality of substrate samples 3-a to 3-g as shown in Table 5.

Each of the resultant substrate samples was positioned on the substrate holder 2113 (comprising a cylindrical holder made of Al) of the plasma CVD apparatus shown in FIG. 1.

Then, in accordance with the foregoing film-forming procedures using the plasma CVD apparatus shown in FIG. 1 and under film-forming conditions shown shown in Table 1, there were formed a charge injection inhibition layer, a photoconductive layer, and a surface layer in the named order on the polished surface of the substrate sample.

By this, there were obtained a plurality of electrophotographic light receiving drum samples.

For the resultant electrophotographic light receiving drum samples, evaluation was conducted with respect to (1) flange fittingness and (2) unevenness in image density in the same manner as in Example 1.

The evaluated results obtained are collectively shown in Table 5.

COMPARATIVE EXAMPLE 2

The procedures of Example 2 were repeated, except that the configuration of the counterbore portion was changed to the linear configuration shown FIG. 3, to thereby obtain a plurality of substrate samples and a plurality of electrophotographic light receiving drum samples.

For the resultant electrophotographic light receiving drum samples, evaluation was conducted with respect to (1) flange fittingness and (2) unevenness in image density in the same manner as in Example 1. The evaluated results obtained are collectively shown in Table 5.

Based on the results shown in Table 5, the following facts are understood. When the ratio between the length (f) of the tapered outer end portion of the counterbore portion and the total length (d) of the counterbore portion is made to be 0.3 or more, a remarkable improvement is provided in the flange fittingness. However, as a result of further observation, there was obtained such findings as will be described in the following. When the ratio between the length (f) of the tapered outer end portion of the counterbore portion and the total length (d) of the counterbore portion is made to be beyond 0.6, the area of the flange-accepting portion of the counterbore portion is liable to diminish and because of this, when the flange as the fixing instrument is engaged with the counterbore portion, the contact area with the flange will sometimes become small so that backlash is liable to occur, where a problem is liable to entail such that a image accompanied by a certain uneven density image at a level which is not problematic in practice.

In view of this, it is understood that to use a drum-like shaped metal substrate whose inner face having a counterbore portion with a specific tapered outer end portion of 0.3 to 0.6 in the ratio between the length (f) of the tapered outer end portion of the counterbore portion and the total length (d) of the counterbore portion provides pronounced advantages in that the end portion of the counterbore portion is effectively supplemented, a remarkable improvement is attained in the flange fittingness, and the production of a high quality electrophotographic light receiving drum which is free of layer peeling and which provides a high quality image which is free of unevenness in image density is enabled.

EXAMPLE 3

There were provided a plurality of cylindrical substrates (drum-like shaped substrates) made of aluminum of 358 mm in length, 80 mm in outer diameter and 3 mm in thickness and having a polished surface.

Each drum-like shaped substrate was subjected to processing to form a couterbore portion (having a tapered outer end portion) of the configuration shown in FIG. 5 at the inner face of each of the opposite end sides thereof under conditions in that the ratio between the minimum thickness (e) of the tapered outer end portion of the counterbore portion and the maximum thickness (c) of the central portion of the counterbore portion is made to be 0.96; the total length (d) of the counterbore portion is made to be 18 mm; the ratio between the length (f) of the tapered outer end portion of the counterbore portion and the total length (d) of the counterbore portion is made to be 0.3; and the ratio between the thickness (c) of the counterbore portion and the thickness (a) of the central portion of the substrate is varied in the range of 0.2 to 0.9.

By this, there were obtained a plurality of substrate samples 4-a to 4-h as shown in Table 6.

Each of the resultant substrate samples was positioned on the substrate holder 2113 (comprising a cylindrical holder made of Al) of the plasma CVD apparatus shown in FIG. 1.

Then, in accordance with the foregoing film-forming procedures using the plasma CVD apparatus shown in FIG. 1 and under film-forming conditions shown shown in Table 1, there were formed a charge injection inhibition layer, a photoconductive layer, and a surface layer in the named order on the polished surface of the substrate sample.

By this, there were obtained a plurality of electrophotographic light receiving drum samples.

For the resultant electrophotographic light receiving drum samples, evaluation was conducted with respect to (1) flange fittingness and (2) unevenness in image density in the same manner as in Example 1.

The evaluated results obtained are collectively shown in Table 6.

Based on the results shown in Table 6, the following facts are understood. To use a drum-like shaped metal substrate whose inner face having a counterbore portion with a specific tapered outer end portion of 0.5 to 0.8 in the ratio between the thickness (c) of the counterbore portion and the thickness (a) of the central portion of the substrate provides pronounced advantages in that the end portion of the counterbore portion is effectively supplemented, a remarkable improvement is attained in the flange fittingness, and the production of a high quality electrophotographic light receiving drum which is free of layer peeling and which provides a high quality image which is free of unevenness in image density is enabled.

EXAMPLE 4

There were provided a plurality of cylindrical substrates (drum-like shaped substrates) made of aluminum of 358 mm in length, 80 mm in outer diameter and 3 mm in thickness and having a polished surface.

Each drum-like shaped substrate was subjected to processing to form a counterbore portion (having a tapered outer end portion) of the configuration shown in FIG. 5 at the inner face of each of the opposite end sides thereof under conditions in that the ratio between the minimum thickness (e) of the tapered outer end portion of the counterbore portion and the maximum thickness (c) of the central portion of the counterbore portion is made to be 0.96; the ratio between the thickness (c) of the counterbore portion and the thickness (a) of the central portion of the substrate is made to be 0.72; the ratio between the length (f) of the tapered outer end portion of the counterbore portion and the total length (d) of the counterbore portion is made to be 0.3; the total length (d) of the counterbore portion is varied in the range of 5 to 23 mm; and a fixing instrument (a flange) having the configuration shown in FIG. 8 is mounted to the face (the portion other than the face f of the tapered outer end portion of each counterbore portion) capable of maintaining a caulking precision.

By this, there were obtained a plurality of substrate samples.

Each of the resultant substrate samples was positioned on the substrate holder 2113 (comprising a cylindrical holder made of Al) of the plasma CVD apparatus shown in FIG. 1.

Then, in accordance with the foregoing film-forming procedures using the plasma CVD apparatus shown in FIG. 1 and under film-forming conditions shown shown in Table 1, there were formed a charge injection inhibition layer, a photoconductive layer, and a surface layer in the named order on the polished surface of the substrate sample.

By this, there were obtained a plurality of electrophotographic light receiving drum samples.

For the resultant electrophotographic light receiving drum samples, evaluation was conducted with respect to (2) unevenness in image density in the same manner as in Example 1.

The evaluated results obtained are collectively shown in Table 7.

COMPARATIVE EXAMPLE 3

The procedures of Example 4 were repeated, except that the configuration of the counterbore portion was changed to the linear configuration shown FIG. 3, to thereby obtain a plurality of substrate samples and a plurality of electrophotographic light receiving drum samples.

For the resultant electrophotographic light receiving drum samples, evaluation was conducted with respect to (2) unevenness in image density in the same manner as in Example 1. The evaluated results obtained are collectively shown in Table 7.

Based on the results shown in Table 7, the following facts are understood. When the foregoing fixing instrument (the flange) is mounted to the face (the portion other than the face f of the tapered outer end portion of the counterbore portion) capable of maintaining a caulking precision, there can be attained caulking at the linear portion free of deformation and because of this, desirable caulking precision can be attained. This situation enables the production of a high quality electrophotographic light receiving drum which provides a high quality image which is free of unevenness in image density.

EXAMPLE 5

There were provided a plurality of cylindrical substrates (drum-like shaped substrates) made of aluminum of 358 mm in length and 80 mm in outer diameter and having a polished surface.

Each drum-like shaped substrate was subjected to processing to form a counterbore portion (having a tapered outer end portion) of the conf iguration shown in FIG. 5 at the inner face of each of the opposite end sides thereof under conditions in that the the total length (d) of the counterbore portion is made to be 18 mm; the ratio between the length (f) of the tapered outer end portion of the counterbore portion and the total length (d) of the counterbore portion is made to be 0.3; the the ratio between the thickness (c) of the counterbore portion and the thickness (a) of the central portion of the substrate is made to be 0.72; the ratio between the minimum thickness (e) of the tapered outer end portion of the counterbore portion and the maximum thickness (c) of the central portion of the counterbore portion is varied in the range of 0.37 to 0.99; the thickness (a) of the central portion of the substrate is varied in the range of from 2.0 to 5.0 mm; and a fixing instrument (a flange) having the configuration shown in FIG. 7 and a fixing instrument (a flange) having the configuration shown in FIG. 11 are mounted respectively to the face g (which is the portion other than the face f of the tapered outer end portion of each counterbore portion) capable of maintaining a caulking precision.

By this, there were obtained a plurality of substrate samples 6-a to 6-i as shown in Table 8.

Each of the resultant substrate samples was positioned on the substrate holder 2113 (comprising a cylindrical holder made of Al) of the plasma CVD apparatus shown in FIG. 1.

Then, in accordance with the foregoing film-forming procedures using the plasma CVD apparatus shown in FIG. 1 and under film-forming conditions shown shown in Table 1, there were formed a charge injection inhibition layer, a photoconductive layer, and a surface layer in the named order on the polished surface of the substrate sample.

By this, there were obtained a plurality of electrophotographic light receiving drum samples.

EVALUATION

For each of the resultant electrophotographic light receiving drum samples, evaluation was conducted with respect to (1) flange fittingness, (2) unevenness in image density, and (3) layer peeling in the following manner. In addition, total evaluation (4) was conducted based on evaluated results for these three evaluation items (1) to The evaluated results obtained are collectively shown in Tables 8 and 9.

(1) Evaluation of the flange fittingness:

There were provided a fixing instrument (a flange) having the configuration shown in FIG. 7 for one counterbore portion and another fixing instrument (a flange) having the configuration shown in FIG. 11 respectively of a caulking tolerance h8 and for installing an electrophotographic light receiving drum in an electrophotographic apparatus.

Using these two fixing instruments, caulking test was conducted by engaging one fixing instrument with one of the opposite counterbore portions and the other fixing instrument with the remaining counterbore portion, where the flange fittingness of the counterbore portions with these fixing instruments was examined. This test was conducted for each of the electrophotographic light receiving drum samples.

The examined results are collectively shown in Table 8 based on the following criteria.

O: a case where the flange fittingness is good enough,

Δ: a case where the flange fittingness is not so good but practically acceptable, and X: a case where the flange fittingness is inferior and therefore, practically problematic.

(2) Evaluation of the unevenness in image density:

In this evaluation, in order to install each electrophotographic light receiving drum sample in an electrophotographic apparatus, there were used two different fixing instruments (flanges) one having the configuration shown in FIG. 7 and of caulking tolerance h8 and the other having the configuration shown in FIG. 11 and of caulking tolerance h8.

Particularly, for each of the electrophotographic light receiving drum samples, there were used two different fixing instruments (flanges), i.e., a fixing instrument (a flange) having the configuration shown in FIG. 7 and which had been adjusted so as to correspond the single bore diameter of one of the opposite counterbore portions thereof with a caulking tolerance h8 and a fixing instrument (a flange) having the configuration shown in FIG. 11 and which had been adjusted so as to correspond the single bore diameter of the remaining counterbore portion with a caulking tolerance h8.

Each electrophotographic light receiving drum sample whose opposite counterbore portions having been engaged with the two fixing instruments (the flanges) in mesh was installed an electrophotographic apparatus NP 6750 having the constitution shown in FIG. 2 and which has been modified to be usable for experimental purposes (produced by Canon Kabushiki Kaisha), wherein using a halftone test chart FY9-9042 (produced by CANON Kabushiki Kaisha) in which the entire area comprises a halftone image as an original, copying shot for an A3-sized paper was conducted under ordinary image-forming conditions to obtain a copied image. For the resultant copied image, thick density areas and thin density areas were selected. And the optical densities of these areas were measured by means of a Macbeth densitometer (produced by Macbeth Company). Based on the measured optical density values, there were obtained (a) a mean value among the measured optical density values for the thick density areas and (b) a mean value among the measured optical density values for the thin density areas. Then, there was obtained a ratio in terms of percentage between the two mean values. The resultant was made to be an unevenness in image density.

This evaluation was conducted for each of the resultant electrophotographic light receiving drum samples.

The evaluated results obtained are collectively shown in Table 8 based on the following criteria.

◎: a case where the unevenness in image density is less than 10% (good enough),

O: a case where the unevenness in image density is in the range of more than 10% to less than 15% (good), Δ; a case where the unevenness in image density in the range of more than 15% to less than 30% (not so good but practically acceptable), and X: a case where the unevenness in image density is more than 30% (practically problematic).

(3) Evaluation of the layer peeling:

For each of the electrophotographic light receiving drums, examination was conducted with respect to layer peeling at its opposite end portions by way of visual inspection.

The examined results are collectively shown in Table 9 based on the following criteria.

O: a case where no layer peeling is present

Δ: a case where layer peeling of less than 1 mm is present but practically acceptable, and X: a case where layer peeling of more than 1 mm is present and seemingly problematic in practice.

(4) Total evaluation:

This evaluation was conducted based on the following criteria.

⊙: a case where the evaluated results of the above evaluation items (1) to (3) are good enough, O: a case where the evaluated results of the above evaluation items (1) to (3) are good, Δ: a case where the evaluated results of the above evaluation items (1) to (3) are not good but practically acceptable, X: a case where the evaluated results of the above evaluation items (1) to (3) are seemingly problematic in practice.

The evaluated results obtained are collectively shown in Table 9.

COMPARATIVE EXAMPLE 4

The procedures of Example 5 were repeated, except that the configuration of the counterbore portion was changed to the linear configuration shown FIG. 3, to thereby obtain a plurality of substrate samples and a plurality of electrophotographic light receiving drum samples.

For the resultant electrophotographic light receiving drum samples, evaluation was conducted with respect to (1) flange fittingness, (2) unevenness in image density, (3) layer peeling, and (4) total evaluation in the same manner as in Example 5. The evaluated results obtained are collectively shown in Tables 8 and 9.

Figure 14:
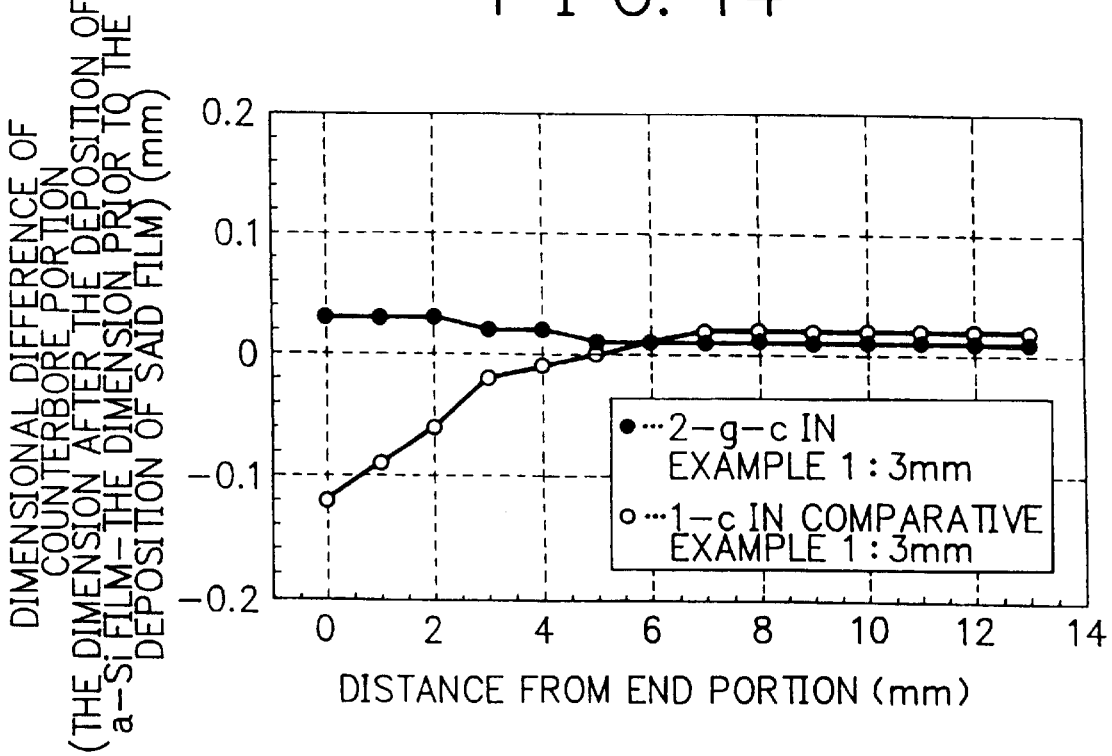

Based on the results shown in Tables 8 and 9, the following facts are understood. When the thickness (c) of the central portion of the drum-like shaped substrate is 3 mm or less, by making the ratio between the minimum thickness (e) of the tapered outer end portion of the counterbore portion and the maximum thickness (c) of the central portion of the counterbore portion to be 0.96 or less, there can be attained an improvement in the flange fittingness. However, when the ratio between the minimum thickness (e) of the tapered outer end portion of the counterbore portion and the maximum thickness (c) of the central portion of the counterbore portion to be less than 0.47, layer peeling is liable to occur at the end portion of the electrophotographic light receiving drum. Therefore, to use a drum-like shaped metal substrate whose inner face having a counterbore portion with a specific tapered outer end portion of 0.47 to 0.96 in the ratio between the minimum thickness (e) of the tapered outer end portion of the counterbore portion and the maximum thickness (c) of the central portion of the counterbore portion provides pronounced advantages in that the end portion of the counterbore portion is effectively supplemented as shown in FIG. 14, and a remarkable improvement is attained in the flange fittingness. In addition, by mounting the foregoing fixing instrument (the flange) to the face (the portion other than the face f of the tapered outer end portion of each counterbore portion, specifically the portion (g) where the inside diameter has been enlarged) capable of maintaining caulking precision, there can be attained caulking at the linear portion free of deformation and because of this, desirable caulking precision can be attained. This situation enables the production of a high quality electrophptographic light receiving drum which is free of layer peeling and which provides a high quality image which is free of unevenness in image density.

EXAMPLE 6

There were provided a plurality of cylindrical substrates (drum-like shaped substrates) made of aluminum of 358 mm in length, 80 mm in outer diameter and 3 mm in thickness and having a polished surface.

Each drum-like shaped substrate was subjected to processing to form a counterbore portion (having a tapered outer end portion) of the configuration shown in FIG. 5 at the inner face of each of the opposite end sides thereof under conditions in that the ratio between the minimum thickness (e) of the tapered outer end portion of the counterbore portion and the maximum thickness (c) of the central portion of the counterbore portion is made to be 0.96; the ratio between the thickness (c) of the counterbore portion and the thickness (a) of the central portion of the substrate is made to be 0.72; the ratio between the length (f) of the tapered outer end portion of the counterbore portion end the total length (d) of the counterbore portion is varied in the range of 0.2 to 0.8; the total length (d) of the counterbore portion is varied in the range of 5 to 23 mm; and a fixing instrument (a flange) having the configuration shown in FIG. 7 and a fixing instrument (a flange) having the configuration shown in FIG. 11 are mounted respectively.

By this, there were obtained a plurality of substrate samples 7-a to 7-g as shown in Table 10.

Each of the resultant substrate samples was positioned on the substrate holder 2113 (comprising a cylindrical holder made of Al) of the plasma CVD apparatus shown in FIG. 1.

Then, in accordance with the foregoing film-forming procedures using the plasma CVD apparatus shown in FIG. 1 and under film-forming conditions shown shown in Table 1, there were formed a charge injection inhibition layer, a photoconductive layer, and a surface layer in the named order on the polished surface of the substrate sample.

By this, there were obtained a plurality of electrophotographic light receiving drum samples.

For the resultant electrophotographic light receiving drum samples, evaluation was conducted with respect to (1) flange fittingness and (2) unevenness in image density in the same manner as in Example 5.

The evaluated results obtained are collectively shown in Table 10.

COMPARATIVE EXAMPLE 5

The procedures of Example 6 were repeated, except that the configuration of the counterbore portion was changed to the linear configuration shown FIG. 3, to thereby obtain a plurality of substrate samples and a plurality of electrophotographic light receiving drum samples.

For the resultant electrophotographic light receiving drum samples, evaluation was conducted with respect to (1) flange fittingness and (2) unevenness in image density in the same manner as in Example 5. The evaluated results obtained are collectively shown in Table 10.

Based on the results shown in Table 10, the following facts are understood. When the ratio between the length (f) of the tapered outer end portion of the counterbore portion and the total length (d) of the counterbore portion is made to be 0.3 or more, a remarkable improvement is provided in the flange fittingness. However, as a result of further observation, there was obtained such findings as will be described in the following. When the ratio between the length (f) of the tapered outer end portion of the counterbore portion and the total length (d) of the counterbore portion is made to be beyond 0.6, the area of the flange-accepting portion of the counterbore portion is liable to diminish and because of this, when the flange as the fixing instrument is engaged with the counterbore portion, the contact area with the flange will sometimes become small so that backlash is liable to occur, where a problem is liable to entail such that a image accompanied by a certain uneven density image at a level which is not problematic in practice.

In view of this, it is understood that to use a drum-like shaped metal substrate whose inner face having a counterbore portion with a specific tapered outer end portion of 0.3 to 0.6 in the ratio between the length (f) of the tapered outer end portion of the counterbore portion and the total length (d) of the counterbore portion provides pronounced advantages in that the end portion of the counterbore portion is effectively supplemented, a remarkable improvement is attained in the flange fittingness. In addition, by mounting the foregoing fixing instrument (the flange) to the face g (which is the portion other than the face f of the tapered outer end portion of each counterbore portion) capable of maintaining caulking precision, there can be attained caulking at the linear portion free of deformation and because of this, desirable caulking precision can be attained. This situation enables the production of a high quality electrophotographic light receiving drum which is free of layer peeling and which provides a high quality image which is free of unevenness in image density.

EXAMPLE 7

There were provided a plurality of cylindrical substrates (drum-like shaped substrates) made of aluminum of 358 mm in length, 80 mm in outer diameter and 3 mm in thickness and having a polished surface.

Each drum-like shaped substrate was subjected to processing to form a counterbore portion (having a tapered outer end portion) of the configuration shown in FIG. 5 at the inner face of each of the opposite end sides thereof under conditions in that the ratio between the minimum thickness (e) of the tapered outer end portion of the counterbore portion and the maximum thickness (c) of the central portion of the counterbore portion is made to be 0.96; the total length (d) of the counterbore portion is made to be 18 mm; the ratio between the length (f) of the tapered outer end portion of the counterbore portion and the total length (d) of the counterbore portion is made to be 0.3; the ratio between the thickness (c) of the counterbore portion and the thickness (a) of the central portion of the substrate is varied in the range of 0.2 to 0.9; and a fixing instrument (a flange) having the configuration shown in FIG. 7 and a fixing instrument (a flange) having the configuration shown in FIG. 11 are mounted respectively.

By this, there were obtained a plurality of substrate samples 8-a to 8-h as shown in Table 11.

Each of the resultant substrate samples was positioned on the substrate holder 2113 (comprising a cylindrical holder made of Al) of the plasma CVD apparatus shown in FIG. 1.

Then, in accordance with the foregoing film-forming procedures using the plasma CVD apparatus shown in FIG. 1 and under film-forming conditions shown shown in Table 1, there were formed a charge injection inhibition layer, a photoconductive layer, and a surface layer in the named order on the polished surface of the substrate sample.

By this, there were obtained a plurality of electrophotographic light receiving drum samples.

For the resultant electrophotographic light receiving drum samples, evaluation was conducted with respect to (1) flange fittingness and (2) unevenness in image density in the same manner as in Example 5.

The evaluated results obtained are collectively shown in Table 11.

Based on the results shown in Table 11, the following facts are understood. To use a drum-like shaped metal substrate whose inner face having a counterbore portion with a specific tapered outer end portion of 0.5 to 0.8 in the ratio between the thickness (c) of the counterbore portion and the thickness (a) of the central portion of the substrate provides pronounced advantages in that the end portion of the counterbore portion is effectively supplemented, and a remarkable improvement is attained in the flange fittingness. In addition, by mounting the foregoing fixing instrument (the flange) to the face g (which is the portion other than the face f of the tapered outer end portion of each counterbore portion) capable of maintaining caulking precision, there can be attained caulking at the linear portion free of deformation and because of this, desirable caulking precision can be attained. This situation enables the production of a high quality electrophotographic light receiving drum which is free of layer peeling and which provides a high quality image which is free of unevenness in image density.

EXAMPLE 8

There were provided a plurality of cylindrical substrates (drum-like shaped substrates) made of aluminum of 358 mm in length, 80 mm in outer diameter and 3 mm in thickness and having a polished surface.

Using there drum-shaped metal substrates, there were prepared a plurality of substrate samples each having opposite counterbore portions of 18 mm in total length in the same manner as in Example 1.

Then, each of the resultant substrate samples was positioned on the substrate holder 2113 (comprising a cylindrical holder made of Al) of the plasma CVD apparatus shown in FIG. 1, where in accordance with the foregoing film-forming procedures using the plasma CVD apparatus shown in FIG. 1 and under film-forming conditions shown shown in Table 12, there were formed a charge injection inhibition layer, a charge transportation layer, a charge generation layer, and a surface layer in the named order on the polished surface of the substrate sample.

By this, there were obtained a plurality of electrophotographic light receiving drum samples.

For the resultant electrophotographic light receiving drum samples, evaluation was conducted with respect to (1) flange fittingness, (2) unevenness in image density, (3) layer peeling, and (4) total evaluation in the same manner as in Example 1.

The evaluated results obtained were found to be similar to those obtained in Example 1.

EXAMPLE 9

There were provided a plurality of cylindrical substrates (drum-like shaped substrates) made of aluminum of 358 mm in length, 80 mm in outer diameter and 3 mm in thickness and having a polished surface.

Using there drum-shaped metal substrates, there were prepared a plurality of substrate samples each having opposite counterbore portions of 18 mm in total length in the same manner as in Example 1.

Then, each of the resultant substrate samples was positioned on the substrate holder 2113 (comprising a cylindrical holder made of Al) of the plasma CVD apparatus shown in FIG. 1, where in accordance with the foregoing film-forming procedures using the plasma CVD apparatus shown in FIG. 1 and under film-forming conditions shown shown in Table 13, there were formed a charge injection inhibition layer, a charge transportation layer, a charge generation layer, an intermediate layer and a surface layer in the named order on the polished surface of the substrate sample.

By this, there were obtained a plurality of electrophotographic light receiving drum samples.

For the resultant electrophotographic light receiving drum samples, evaluation was conducted with respect to (1) flange fittingness, (2) unevenness in image density, (3) layer peeling, and (4) total evaluation in the same manner as in Example 1.

The evaluated results obtained were found to be similar to those obtained in Example 1.

EXAMPLE 10

There were provided a plurality of cylindrical substrates (drum-like shaped substrates) made of aluminum of 358 mm in length, 108 mm in outer diameter and 3 mm in thickness and having a polished surface.

Using there drum-shaped metal substrates, there were prepared a plurality of substrate samples each having opposite counterbore portions of 18 mm in total length in the same manner as in Example 1.

Then, each of the resultant substrate samples was positioned on the substrate holder 2113 (comprising a cylindrical holder made of Al) of the plasma CVD apparatus shown in FIG. 1, where in accordance with the foregoing film-forming procedures using the plasma CVD apparatus shown in FIG. 1 and under film-forming conditions shown shown in Table 1, there were formed a charge injection inhibition layer, a photoconductive layer and a surface layer in the named order on the polished surface of the substrate sample.

By this, there were obtained a plurality of electrophotographic light receiving drum samples.

For the resultant electrophotographic light receiving drum samples, evaluation was conducted with respect to (1) flange fittingness, (2) unevenness in image density, (3) layer peeling, and (4) total evaluation in the same manner as in Example 1.

The evaluated results obtained were found to be similar to those obtained in Example 1.

EXAMPLE 11

There were provided a plurality of cylindrical substrates (drum-like shaped substrates) made of aluminum of 358 mm in length, 80 mm in outer diameter and 3 mm in thickness and having a polished surface.

Using there drum-shaped metal substrates, there were prepared a plurality of substrate samples each having opposite counterbore portions of 18 mm in total length in the same manner as in Example 5.

Then, each of the resultant substrate samples was positioned on the substrate holder 2113 (comprising a cylindrical holder made of Al) of the plasma CVD apparatus shown in FIG. 1, where in accordance with the foregoing film-forming procedures using the plasma CVD apparatus shown in FIG. 1 and under film-forming conditions shown shown in Table 12, there were formed a charge injection inhibition layer, a charge transportation layer, a charge generation layer, and a surface layer in the named order on the polished surface of the substrate sample.

By this, there were obtained a plurality of electrophotographic light receiving drum samples.

For the resultant electrophotographic light receiving drum samples, using a combination of a fixing instrument (a flange) having the configuration shown in FIG. 7 and a fixing instrument (a flange) having the configuration shown in FIG. 11, evaluation was conducted with respect to (1) flange fittingness, (2) unevenness in image density, (3) layer peeling, and (4) total evaluation in the same manner as in Example 5.

The evaluated results obtained were found to be similar to those obtained in Example 5.

EXAMPLE 12

There were provided a plurality of cylindrical substrates (drum-like shaped substrates) made of aluminum of 358 mm in length, 80 mm in outer diameter and 3 mm in thickness and having a polished surface.

Using there drum-shaped metal substrates, there were prepared a plurality of substrate samples each having opposite counterbore portions of 18 mm in total length in the same manner as in Example 5.

Then, each of the resultant substrate samples was positioned on the substrate holder 2113 (comprising a cylindrical holder made of Al) of the plasma CVD apparatus shown in FIG. 1, where in accordance with the foregoing film-forming procedures using the plasma CVD apparatus shown in FIG. 1 and under film-forming conditions shown shown in Table 13, there were formed a charge injection inhibition layer, a charge transportation layer, a charge generation layer, an intermediate layer and a surface layer in the named order on the polished surface of the substrate sample.

By this, there were obtained a plurality of electrophotographic light receiving drum samples.

For the resultant electrophotographic light receiving drum samples, using a combination of a fixing instrument (a flange) having the configuration shown in FIG. 7 and a fixing instrument (a flange) having the configuration shown in FIG. 11, evaluation was conducted with respect to (1) flange fittingness, (2) unevenness in image density, (3) layer peeling, and (4) total evaluation in the same manner as in Example 5.

The evaluated results obtained were found to be similar to those obtained in Example 5.

EXAMPLE 13

There were provided a plurality of cylindrical substrates (drum-like shaped substrates) made of aluminum of 358 mm in length, 108 mm in outer diameter and 3 mm in thickness and having a polished surface.

Using there drum-shaped metal substrates, there were prepared a plurality of substrate samples each having opposite counterbore portions of 18 mm in total length in the same manner as in Example 5.

Then, each of the resultant substrate samples was positioned on the substrate holder 2113 (comprising a cylindrical holder made of Al) of the plasma CVD apparatus shown in FIG. 1, where in accordance with the foregoing film-forming procedures using the plasma CVD apparatus shown in FIG. 1 and under film-forming conditions shown shown in Table 1, there were formed a charge injection inhibition layer, a photoconductive layer and a surface layer in the named order on the polished surface of the substrate sample.

By this, there were obtained a plurality of electrophotographic light receiving drum samples.

For the resultant electrophotographic light receiving drum samples, using a combination of a fixing instrument (a flange) having the configuration shown in FIG. 11 and a fixing instrument (a flange) having the configuration shown in FIG. 12, evaluation was conducted with respect to (1) flange fittingness, (2) unevenness in image density, (3) layer peeling, and (4) total evaluation in the same manner as in Example 5.

The evaluated results obtained were found to be similar to those obtained in Example 5.

EXAMPLE 14

There were provided a plurality of cylindrical substrates (drum-like shaped substrates) made of aluminum of 358 mm in length, 80 mm in outer diameter and 3 mm in thickness and having a polished surface.

Using there drum-shaped metal substrates, there were prepared a plurality of substrate samples each having opposite counterbore portions of 18 mm in total length in the same manner as in Example 5.

Then, each of the resultant substrate samples was positioned on the substrate holder 2113 (comprising a cylindrical holder made of Al) of the plasma CVD apparatus shown in FIG. 1, where in accordance with the foregoing film-forming procedures using the plasma CVD apparatus shown in FIG. 1 and under film-forming conditions shown shown in Table 12, there were formed a charge injection inhibition layer, a charge transportation layer, a charge generation layer, and a surface layer in the named order on the polished surface of the substrate sample.

By this, there were obtained a plurality of electrophotographic light receiving drum samples.

For the resultant electrophotographic light receiving drum samples, using a combination of a fixing instrument (a flange) having the configuration shown in FIG. 7 and a fixing instrument (a flange) having the configuration shown in FIG. 12, evaluation was conducted with respect to (1) flange fittingness, (2) unevenness in image density, (3) layer peeling, and (4) total evaluation in the same manner as in Example 5.

The evaluated results obtained were found to be similar to those obtained in Example 5.

EXAMPLE 15

There were provided a plurality of cylindrical substrates (drum-like shaped substrates) made of aluminum of 358 mm in length, 108 mm in outer diameter and 3 mm in thickness and having a polished surface.

Using there drum-shaped metal substrates, there were prepared a plurality of substrate samples each having opposite counterbore portions of 18 mm in total length in the same manner as in Example 5.

Then, each of the resultant substrate samples was positioned on the substrate holder 2113 (comprising a cylindrical holder made of Al) of the plasma CVD apparatus shown in FIG. 1, where in accordance with the foregoing film-forming procedures using the plasma CVD apparatus shown in FIG. 1 and under film-forming conditions shown shown in Table 1, there were formed a charge injection inhibition layer, a photoconductive layer and a surface layer in the named order on the polished surface of the substrate sample.

By this, there were obtained a plurality of electrophotographic light receiving drum samples.

For the resultant electrophotographic light receiving drum samples, using a combination of a fixing instrument (a flange) having the configuration shown in FIG. 7 and a fixing instrument (a flange) having the configuration shown in FIG. 12, evaluation was conducted with respect to (1) flange fittingness, (2) unevenness in image density, (3) layer peeling, and (4) total evaluation in the same manner as in Example 5.

The evaluated results obtained were found to be similar to those obtained in Example 5.

As apparent from the above description, according to the present invention, to use a drum-like shaped metal substrate whose inner face having a counterbore portion with a specific tapered outer end portion at each of the opposite end portions enables to effectively produce a desirable an electrophotographic light receiving member in a cylindrical form having pronounced advantages as will be described in the following. The light receiving member is desirably prevented from being deformed at the opposite end portions. Each of the opposite counterbore portions of the light receiving member can be effectively engaged with a fixing member (a flange) in mesh in a desirable state in order to desirably install the light receiving member in an electrophotographic apparatus. Further, the drum-like shaped substrate according to the present invention has an improved face for attaining desirable caulking with the fixing instrument (the flange) with a high fittingness precision. This situation enables to attain a high quality electrophotographic light receiving member in a cylindrical form which can be desirably installed in an electrophotographic apparatus, where the light receiving member stably provides a high quality image which is free of unevenness in image density.

TABLE 1

| | charge injection inhibition layer | photoconductive layer | surface layer |
|---|---|---|---|
| gas used & it's flow rate | | | |
| $SiH_4$ (sccm) | 195 | 195→430→430 | 186→168→30→25 |
| $H_2$ (sccm) | 390 | 390→2150→2150 | |
| $B_2H_6$ (ppm) [against $SiH_4$] | 1500 | 1.25 | |
| NO (sccm) | 6.5 | 0 | |
| $CH_4$ (sccm) | 0 | 0 | 752→848→1488→1527 |
| inner pressure (mmTorr) | 285 | 285→550→550 | 300→450→450 |
| RF Power (w) | 160 | 160→700→700 | 250 |
| substrate temperature (°C.) | 250 | 270 | 250 |
| time (min) | 68 | 10→350 | 1→0.25→30 |

TABLE 2

| conditions | 1-a | 1-b | 1-c | 1-d | 1-e |
|---|---|---|---|---|---|
| thickness of central portion (a) [mm] | 5.0 | 4.0 | 3.0 | 2.5 | 2.0 |
| thickness of counterbore portion (c) [mm] | 3.6 | 2.88 | 2.15 | 1.8 | 1.44 |
| evaluated result of the evaluation item (1) | ○ | ○ | x | x | x |
| evaluated result of the evaluation item (2) | ○ | ○ | Δ | Δ | Δ |

TABLE 3

| thickness of central portion (a) [mm] | | | | 5.0 | 4.0 | 3.0 | 2.5 | 2.0 |
|---|---|---|---|---|---|---|---|---|
| thickness of counterbore portion (c) [mm] | | | | 3.6 | 2.88 | 2.15 | 1.8 | 1.44 |
| | | condition | ratio of (e)/(c) | a | b | c | d | e |
| evaluated result of the evaluation item (1) | Example 1 | 2-a | 0.37 | ○ | ○ | ○ | ○ | ○ |
| | | 2-b | 0.47 | ○ | ○ | ○ | ○ | ○ |
| | | 2-c | 0.6 | ○ | ○ | ○ | ○ | ○ |
| | | 2-d | 0.7 | ○ | ○ | ○ | ○ | ○ |
| | | 2-e | 0.8 | ○ | ○ | ○ | ○ | ○ |
| | | 2-f | 0.93 | ○ | ○ | ○ | ○ | ○ |
| | | 2-g | 0.96 | ○ | ○ | ○ | ○ | ○ |
| | | 2-h | 0.98 | ○ | ○ | ○ | Δ | Δ |
| | | 2-i | 0.99 | ○ | ○ | Δ | Δ | Δ |
| | Comparative Example 1 | (1) | (1.0) | ○ | ○ | x | x | x |
| evaluated result of the evaluation item (2) | Example 1 | 2-a | 0.37 | ○ | ○ | ○ | ○ | ○ |
| | | 2-b | 0.47 | ○ | ○ | ○ | ○ | ○ |
| | | 2-c | 0.6 | ○ | ○ | ○ | ○ | ○ |
| | | 2-d | 0.7 | ○ | ○ | ○ | ○ | ○ |
| | | 2-e | 0.8 | ○ | ○ | ○ | ○ | ○ |
| | | 2-f | 0.93 | ○ | ○ | ○ | ○ | ○ |
| | | 2-g | 0.96 | ○ | ○ | ○ | ○ | ○ |
| | | 2-h | 0.98 | ○ | ○ | ○ | ○ | ○ |
| | | 2-i | 0.99 | ○ | ○ | ○ | ○ | ○ |
| | Comparative Example 1 | (1) | (1.0) | ○ | ○ | Δ | Δ | Δ |

TABLE 4

| thickness of central portion (a) [mm] | | | | 5.0 | 4.0 | 3.0 | 2.5 | 2.0 |
|---|---|---|---|---|---|---|---|---|
| thickness of counterbore portion (c) [mm] | | | | 3.6 | 2.88 | 2.15 | 1.8 | 1.44 |
| | | condition | ratio of (e)/(c) | a | b | c | d | e |
| evaluated result of the evaluation item (3) | Example 1 | 2-a | 0.37 | ○ | ○ | Δ | Δ | Δ |
| | | 2-b | 0.47 | ○ | ○ | ○ | ○ | ○ |
| | | 2-c | 0.6 | ○ | ○ | ○ | ○ | ○ |
| | | 2-d | 0.7 | ○ | ○ | ○ | ○ | ○ |
| | | 2-e | 0.8 | ○ | ○ | ○ | ○ | ○ |
| | | 2-f | 0.93 | ○ | ○ | ○ | ○ | ○ |
| | | 2-g | 0.96 | ○ | ○ | ○ | ○ | ○ |
| | | 2-h | 0.98 | ○ | ○ | ○ | ○ | ○ |
| | | 2-i | 0.99 | ○ | ○ | ○ | ○ | Δ |
| | Comparative Example 1 | (1) | (1.0) | ○ | ○ | ○ | ○ | Δ |
| evaluated result of the evaluation item (4) | Example 1 | 2-a | 0.37 | ◎ | ◎ | ○ | ○ | Δ |
| | | 2-b | 0.47 | ◎ | ◎ | ◎ | ○ | ○ |
| | | 2-c | 0.6 | ◎ | ◎ | ◎ | ◎ | ○ |
| | | 2-d | 0.7 | ◎ | ◎ | ◎ | ◎ | ◎ |
| | | 2-e | 0.8 | ◎ | ◎ | ◎ | ◎ | ◎ |
| | | 2-f | 0.93 | ◎ | ◎ | ◎ | ◎ | ◎ |
| | | 2-g | 0.96 | ◎ | ◎ | ◎ | ◎ | ◎ |
| | | 2-h | 0.98 | ◎ | ◎ | ◎ | ◎ | ◎ |
| | | 2-i | 0.99 | ◎ | ◎ | ◎ | ◎ | ○ |
| | Comparative Example 1 | (1) | (1.0) | ◎ | ◎ | Δ | x | x |

TABLE 5

| total length of counterbore portion (d) [mm] | | | | 5 | 8 | 10 | 13 | 18 | 23 |
|---|---|---|---|---|---|---|---|---|---|
| | | condition | ratio of (e)/(c) | a | b | c | d | e | f |
| evaluated result of the evaluation item (1) | Example 2 | 3-a | 0.2 | Δ | Δ | Δ | Δ | Δ | Δ |
| | | 3-b | 0.3 | ○ | ○ | ○ | ○ | ○ | ○ |
| | | 3-c | 0.4 | ○ | ○ | ○ | ○ | ○ | ○ |
| | | 3-d | 0.5 | ○ | ○ | ○ | ○ | ○ | ○ |
| | | 3-e | 0.6 | ○ | ○ | ○ | ○ | ○ | ○ |
| | | 3-f | 0.7 | ○ | ○ | ○ | ○ | ○ | ○ |
| | | 3-g | 0.8 | ○ | ○ | ○ | ○ | ○ | ○ |
| | Comparative Example 2 | (2) | | x | x | x | x | x | x |
| evaluated result of the evaluation item (2) | Example 2 | 3-a | 0.2 | ○ | ○ | ○ | ○ | ○ | ○ |
| | | 3-b | 0.3 | ○ | ○ | ○ | ○ | ○ | ○ |
| | | 3-c | 0.4 | ○ | ○ | ○ | ○ | ○ | ○ |
| | | 3-d | 0.5 | ○ | ○ | ○ | ○ | ○ | ○ |
| | | 3-e | 0.6 | ○ | ○ | ○ | ○ | ○ | ○ |
| | | 3-f | 0.7 | Δ | ○ | ○ | ○ | ○ | ○ |
| | | 3-g | 0.8 | Δ | Δ | ○ | ○ | ○ | ○ |
| | Comparative Example 2 | (2) | | Δ | Δ | Δ | Δ | Δ | Δ |

TABLE 6

| condition | 4-a | 4-b | 4-c | 4-d | 4-e | 4-f | 4-g | 4-h |
|---|---|---|---|---|---|---|---|---|
| ratio of (c)/(a) | 0.2 | 0.3 | 0.4 | 0.5 | 0.6 | 0.7 | 0.8 | 0.9 |
| evaluated result of the evaluation item (1) | Δ | Δ | Δ | ○ | ○ | ○ | ○ | ○ |
| evaluated result of the evaluation item (2) | Δ | Δ | ○ | ○ | ○ | ○ | ○ | Δ |

TABLE 7

| total length of counterbore portion (d) [mm] | | | | 5 | 8 | 10 | 13 | 18 | 23 |
|---|---|---|---|---|---|---|---|---|---|
| | | condition | | a | b | c | d | e | f |
| evaluated result of the evaluation item (2) | | 5-a | other portion than the portion (f) | ◎ | ◎ | ◎ | ◎ | ◎ | ◎ |
| | Comprative Example 3 | (3) | | Δ | Δ | Δ | Δ | Δ | Δ |

TABLE 8

| thickness of central portion (a) [mm] | | | | 5.0 | 4.0 | 3.0 | 2.5 | 2.0 |
|---|---|---|---|---|---|---|---|---|
| thickness of counterbore portion (c) [mm] | | | | 3.6 | 2.88 | 2.15 | 1.8 | 1.44 |
| | | condition | ratio of (e)/(c) | a | b | c | d | e |
| evaluated result of the evaluation item (1) | Example 5 | 6-a | 0.37 | ○ | ○ | ○ | ○ | ○ |
| | | 6-b | 0.47 | ○ | ○ | ○ | ○ | ○ |
| | | 6-c | 0.6 | ○ | ○ | ○ | ○ | ○ |
| | | 6-d | 0.7 | ○ | ○ | ○ | ○ | ○ |
| | | 6-e | 0.8 | ○ | ○ | ○ | ○ | ○ |
| | | 6-f | 0.93 | ○ | ○ | ○ | ○ | ○ |
| | | 6-g | 0.96 | ○ | ○ | ○ | ○ | ○ |
| | | 6-h | 0.98 | ○ | ○ | ○ | Δ | Δ |
| | | 6-i | 0.99 | ○ | ○ | Δ | Δ | Δ |
| | Comparative Example 4 | (4) | (1.0) | ○ | ○ | x | x | x |
| evaluated result of the evaluation | Example 5 | 6-a | 0.37 | ◎ | ◎ | ◎ | ◎ | ◎ |
| | | 6-b | 0.47 | ◎ | ◎ | ◎ | ◎ | ◎ |
| | | 6-c | 0.6 | ◎ | ◎ | ◎ | ◎ | ◎ |
| | | 6-d | 0.7 | ◎ | ◎ | ◎ | ◎ | ◎ |

TABLE 8-continued

| | | | | | | | | |
|---|---|---|---|---|---|---|---|---|
| item (2) | | 6-e | 0.8 | ◎ | ◎ | ◎ | ◎ | ◎ |
| | | 6-f | 0.93 | ◎ | ◎ | ◎ | ◎ | ◎ |
| | | 6-g | 0.96 | ◎ | ◎ | ◎ | ◎ | ◎ |
| | | 6-h | 0.98 | ◎ | ◎ | ◎ | ○ | ○ |
| | | 6-i | 0.99 | ◎ | ◎ | ○ | ○ | ○ |
| | Comparative Example 4 | (4) | (1.0) | ○ | ○ | Δ | Δ | Δ |

TABLE 9

| thickness of central portion (a) [mm] | | | | 5.0 | 4.0 | 3.0 | 2.5 | 2.0 |
|---|---|---|---|---|---|---|---|---|
| thickness of counterbore portion (c) [mm] | | | | 3.6 | 2.88 | 2.15 | 1.8 | 1.44 |
| | | condition | ratio of (e)/(c) | a | b | c | d | e |
| evaluated result of the evaluation item (3) | Example 5 | 6-a | 0.37 | ○ | ○ | Δ | Δ | x |
| | | 6-b | 0.47 | ○ | ○ | ○ | ○ | ○ |
| | | 6-c | 0.6 | ○ | ○ | ○ | ○ | ○ |
| | | 6-d | 0.7 | ○ | ○ | ○ | ○ | ○ |
| | | 6-e | 0.8 | ○ | ○ | ○ | ○ | ○ |
| | | 6-f | 0.93 | ○ | ○ | ○ | ○ | ○ |
| | | 6-g | 0.96 | ○ | ○ | ○ | ○ | ○ |
| | | 6-h | 0.98 | ○ | ○ | ○ | ○ | ○ |
| | | 6-i | 0.99 | ○ | ○ | ○ | ○ | Δ |
| | Comparative Example 4 | (4) | (1.0) | ○ | ○ | ○ | ○ | Δ |
| evaluated result of the evaluation item (4) | Example 5 | 6-a | 0.37 | ◎ | ◎ | ○ | ○ | x |
| | | 6-b | 0.47 | ◎ | ◎ | ◎ | ○ | ○ |
| | | 6-c | 0.6 | ◎ | ◎ | ◎ | ◎ | ○ |
| | | 6-d | 0.7 | ◎ | ◎ | ◎ | ◎ | ◎ |
| | | 6-e | 0.8 | ◎ | ◎ | ◎ | ◎ | ◎ |
| | | 6-f | 0.93 | ◎ | ◎ | ◎ | ◎ | ◎ |
| | | 6-g | 0.96 | ◎ | ◎ | ◎ | ◎ | ◎ |
| | | 6-h | 0.98 | ◎ | ◎ | ◎ | ◎ | ◎ |
| | | 6-i | 0.99 | ◎ | ◎ | ◎ | ◎ | ○ |
| | Comparative Example 4 | (4) | (1.0) | ◎ | ◎ | Δ | x | x |

TABLE 10

| total length of counterbore portion (d) [mm] | | | | 5 | 8 | 10 | 13 | 18 | 23 |
|---|---|---|---|---|---|---|---|---|---|
| | | condition | ratio of (e)/(c) | a | b | c | d | e | f |
| evaluated result of the evaluation item (1) | Example 6 | 7-a | 0.2 | Δ | Δ | Δ | Δ | Δ | Δ |
| | | 7-b | 0.3 | ○ | ○ | ○ | ○ | ○ | ○ |
| | | 7-c | 0.4 | ○ | ○ | ○ | ○ | ○ | ○ |
| | | 7-d | 0.5 | ○ | ○ | ○ | ○ | ○ | ○ |
| | | 7-e | 0.6 | ○ | ○ | ○ | ○ | ○ | ○ |
| | | 7-f | 0.7 | ○ | ○ | ○ | ○ | ○ | ○ |
| | | 7-g | 0.8 | ○ | ○ | ○ | ○ | ○ | ○ |
| | Comparative Example 5 | | (5) | x | x | x | x | x | x |
| evaluated result of the evaluation item (2) | Example 6 | 7-a | 0.2 | ◎ | ◎ | ○ | ○ | ○ | ○ |
| | | 7-b | 0.3 | ◎ | ◎ | ◎ | ◎ | ◎ | ◎ |
| | | 7-c | 0.4 | ◎ | ◎ | ◎ | ◎ | ◎ | ◎ |
| | | 7-d | 0.5 | ◎ | ◎ | ◎ | ◎ | ◎ | ◎ |
| | | 7-e | 0.6 | ○ | ◎ | ◎ | ◎ | ◎ | ◎ |
| | | 7-f | 0.7 | Δ | ○ | ○ | ○ | ○ | ○ |
| | | 7-g | 0.8 | Δ | ○ | ○ | ○ | ○ | ○ |
| | Comparative Example 5 | | (5) | Δ | Δ | Δ | Δ | Δ | Δ |

TABLE 11

| condition | 8-a | 8-b | 8-c | 8-d | 8-e | 8-f | 8-g | 8-h |
|---|---|---|---|---|---|---|---|---|
| ratio of (c)/(a) | 0.2 | 0.3 | 0.4 | 0.5 | 0.6 | 0.7 | 0.8 | 0.9 |
| evaluated result of the evaluation item (1) | Δ | Δ | Δ | ○ | ○ | ○ | ○ | ○ |

TABLE 11-continued

| condition | 8-a | 8-b | 8-c | 8-d | 8-e | 8-f | 8-g | 8-h |
|---|---|---|---|---|---|---|---|---|
| evaluated result of the evaluation item (2) | Δ | Δ | ○ | ◎ | ◎ | ◎ | ○ | Δ |

TABLE 12

| | charge injection inhibition layer | charge transportation layer | charge generation layer | surface layer |
|---|---|---|---|---|
| gas used & it's flow rate | | | | |
| $SiH_4$ (sccm) | 200 | 300 | 100 | 30 |
| $H_2$ (sccm) | 500 | 1000 | 600 | |
| $B_2H_6$ (ppm) [against $SiH_4$] | | 5→1 | 1 | 5 |
| $PH_3$ (sccm) [against $SiH_4$] | 500 | | | |
| $CO_2$ (sccm) | 0.5 | 0.5 | 0.1 | 0.1 |
| $CH_4$ (sccm) | 20 | 100→0 | 0.1 | 500 |
| substrate temperature (°C.) | 250 | 250 | 250 | 250 |
| inner pressure (Torr) | 0.3 | 0.5 | 0.5 | 0.2 |
| Power (W) | 100 | 600 | 500 | 300 |
| layer thickness (μm) | 3 | 30 | 2 | 0.5 |
| configuration of counterbore portion | (f)/(d) = 0.3<br>(e)/(c) = 0.96<br>(c)/(a) = 0.72<br>(d–f)/(d) = 0.7 | | | |

TABLE 13

| | charge injection inhibition layer | charge transportation layer | charge generation layer | intermediate layer | surface layer |
|---|---|---|---|---|---|
| gas used & it's flow rate | | | | | |
| $SiH_4$ (sccm) | 200 | 300 | 100 | 30 | 30 |
| $H_2$ (sccm) | 500 | 1000 | 600 | | |
| $B_2H_6$ (ppm) [against $SiH_4$] | | 5→1 | 1 | 300 | 5 |
| $PH_3$ (sccm) [against $SiH_4$] | 500 | | | | |
| $CO_2$ (sccm) | 0.5 | 0.5 | 0.1 | 0.1 | 0.1 |
| $CH_4$ (sccm) | 20 | 100→0 | 0.1 | 200 | 500 |
| substrate temperature (°C.) | 250 | 250 | 250 | 250 | 250 |
| inner pressure (Torr) | 0.3 | 0.5 | 0.5 | 0.2 | 0.2 |
| Power (W) | 100 | 600 | 500 | 200 | 300 |
| layer thickness (μm) | 3 | 30 | 2 | 0.1 | 0.5 |
| configuration of counterbore portion | (f)/(d) = 0.3<br>(e)/(c) = 0.96<br>(c)/(a) = 0.72<br>(d–f)/(d) = 0.7 | | | | |

What is claimed is:

1. An electrophotographic light receiving member comprising a substrate in a cylindrical form and a light receiving layer formed on said substrate, wherein said substrate has (i) a portion with an enlarged bore at least on the side of an end portion of said substrate and (ii) a portion in a tapered form situated next to and outside said portion (i).

2. An electrophotographic light receiving member according to claim 1, wherein the portion (i) has a thickness (c), the tapered portion (ii) has a minimum thickness (e), and the ratio of said minimum thickness (e) to said thickness (c) is in the range of 0.47 to 0.96.

3. An electrophotographic light receiving member according to claim 2, wherein the thickness (c) is a maximum thickness of a central portion of the portion (i) in the longitudinal direction.

4. An electrophotographic light receiving member according to claim 1, wherein the tapered portion (ii) has a length (f), the portion (i) has a length (d) in the longitudinal direction, and the ratio of said length (f) to said length (d) is in the range of 0.3 to 0.6.

5. An electrophotographic light receiving member according to claim 2, wherein the portion (i) has a length (d) in the longitudinal direction, the tapered portion (ii) has a length (f), and the ratio of said length (f) to said length (d) is in the range of 0.3 to 0.6.

6. An electrophotographic light receiving member according to claim 3, wherein the portion (i) has a length (d) in the longitudinal direction, the tapered portion (ii) has a length (f), and the ratio of said length (f) to said length (d) is in the range of 0.3 to 0.6.

7. An electrophotographic light receiving member according to claim 1, wherein the substrate has a central portion with a thickness (a), the portion (i) has a thickness (c), and the ratio of said thickness (c) to said thickness (a) is in the range of 0.5 to 0.8.

8. An electrophotographic light receiving member according to claim 4, wherein the substrate has a central portion with a thickness (a), the portion (i) has a thickness (c), and the ratio of said thickness (c) to said thickness (a) is in the range of 0.5 to 0.8.

9. An electrophotographic light receiving member according to claim 5, wherein the substrate has a central portion with a thickness (a), the portion (i) has a thickness (c), and the ratio of said thickness (c) to said thickness (a) is in the range of 0.5 to 0.8.

10. An electrophotographic light receiving member according to claim 7, wherein the thickness (c) is a maximum thickness of a central portion of the portion (i) in the longitudinal direction.

11. An electrophotographic light receiving member according to claim 1, wherein the substrate has a central portion with a thickness of 3 mm or less.

12. An electrophotographic light receiving member according to claim 7, wherein the thickness (a) is 3 mm or less.

13. An electrophotographic light receiving member according to claim 8, wherein the thickness (a) is 3 mm or less.

14. An electrophotographic light receiving member according to claim 9, wherein the thickness (a) is 3 mm or less.

15. An electrophotographic light receiving member according to claim 1, wherein the light receiving layer comprises an amorphous material containing silicon atoms as a matrix.

16. An electrophotographic light receiving member according to claim 1, wherein the substrate is constituted by a metallic material.

17. An electrophotographic light receiving member according to claim 1, wherein the substrate is constituted by an aluminum material or an aluminum alloy material.

18. An electrophotographic light receiving member according to claim 1, wherein the light receiving layer comprises a layer formed by a manner of heating the substrate.

19. An electrophotographic light receiving member comprising a substrate in a cylindrical form, a light receiving layer formed on said substrate, and a fixing member for sustaining said substrate which is equipped in mesh with said substrate on the side of at least an end portion of said substrate, wherein said substrate has (i) a portion whose bore is enlarged on the side of said end portion of said substrate and (ii) a tapered portion having a thickness which is gradually thinned than that of said portion (i) in a direction toward said end portion of said substrate, and said fixing member is provided in contact with said portion (i).

20. An electrophotographic light receiving member according to claim 19, wherein the position of the fixing member is regulated in an end face of the substrate.

21. An electrophotographic light receiving member according to claim 19, wherein the position of the fixing member is regulated by means of a step in an enlarged bore region of the portion (i).

22. An electrophotographic light receiving member according to claim 19 which further comprises a fixing member for retaining the substrate which is provided at the remaining end portion of the substrate, wherein the two fixing members have the same or a different configuration.

23. An electrophotographic light receiving member according to claim 19, wherein the portion (i) has a thickness (c), the tapered portion (ii) has a minimum thickness (e), and the ratio of said minimum thickness (e) to said thickness (c) is in the range of 0.47 to 0.96.

24. An electrophotographic light receiving member according to claim 23, wherein the thickness (c) is a maximum thickness of a central portion of the portion (i) in the longitudinal direction.

25. An electrophotographic light receiving member according to claim 19, wherein the tapered portion (ii) has a length (f), the portion (i) has a length (d) in the longitudinal direction, and the ratio of said length (f) to said length (d) is in the range of 0.3 to 0.6.

26. An electrophotographic light receiving member according to claim 23, wherein the portion (i) has a length (d) in the longitudinal direction, the tapered portion (ii) has a length (f), and the ratio of said length (f) to said length (d) is in the range of 0.3 to 0.6.

27. An electrophotographic light receiving member according to claim 24, wherein the portion (i) has a length (d) in the longitudinal direction, the tapered portion (ii) has a length (f), and the ratio of said length (f) to said length (d) is in the range of 0.3 to 0.6.

28. An electrophotographic light receiving member according to claim 19, wherein the substrate has a central portion with a thickness (a), the portion (i) has a thickness (c), and the ratio of said thickness (c) to said thickness (a) is in the range of 0.5 to 0.8.

29. An electrophotographic light receiving member according to claim 25, wherein the substrate has a central portion with a thickness (a), the portion (i) has a thickness (c), and the ratio of said thickness (c) to said thickness (a) is in the range of 0.5 to 0.8.

30. An electrophotographic light receiving member according to claim 26, wherein the substrate has a central portion with a thickness (a), the portion (i) has a thickness (c), and the ratio of said thickness (c) to said thickness (a) is in the range of 0.5 to 0.8.

31. An electrophotographic light receiving member according to claim 28, wherein the thickness (c) is a maximum thickness of a central portion of the portion (i) in the longitudinal direction.

32. An electrophotographic light receiving member according to claim 19, wherein the substrate has a central portion with a thickness of 3 mm or less.

33. An electrophotographic light receiving member according to claim 28, wherein the thickness (a) is 3 mm or less.

34. An electrophotographic light receiving member according to claim 29, wherein the thickness (a) is 3 mm or less.

35. An electrophotographic light receiving member according to claim 30, wherein the thickness (a) is 3 mm or less.

36. An electrophotographic light receiving member according to claim 19, wherein the light receiving layer comprises an amorphous material containing silicon atoms as a matrix.

37. An electrophotographic light receiving member according to claim 19, wherein the substrate is constituted by a metallic material.

38. An electrophotographic light receiving member according to claim 19, wherein the substrate is constituted by an aluminum material or an aluminum alloy material.

39. An electrophotographic light receiving member according to claim 19, wherein the light receiving layer comprises a layer formed by a manner of heating the substrate.

40. An electrophotographic light receiving member according to claim 19, wherein the fixing member is configured such that it has at least a portion (X) capable of maintaining a fittingness precision with a face other than the tapered portion (ii), a portion (Y) having a face to be contacted with the end portion of the substrate and a non-contacting portion (Z) between said portions (X) and (Y) so as to satisfy the following equation $Z<X<Y$.

41. A substrate in a cylindrical form for an electrophotographic light receiving member, said substrate having (i) a portion with an enlarged bore at least on the side of an end portion of said substrate and (ii) a portion in a tapered form situated next to and outside said portion (i).

42. A substrate according to claim 41, wherein the portion (i) has a thickness (c), the tapered portion (ii) has a minimum thickness (e), and the ratio of said minimum thickness (e) to said thickness (c) is in the range of 0.47 to 0.96.

43. A substrate according to claim 42, wherein the thickness (c) is a maximum thickness of a central portion of the portion (i) in the longitudinal direction.

44. A substrate according to claim 41, wherein the tapered portion (ii) has a length (f), the portion (i) has a length (d) in the longitudinal direction, and the ratio of said length (f) to said length (d) is in the range of 0.3 to 0.6.

45. A substrate according to claim 42, wherein the portion (i) has a length (d) in the longitudinal direction, the tapered portion (ii) has a length (f), and the ratio of said length (f) to said length (d) is in the range of 0.3 to 0.6.

46. A substrate according to claim 43, wherein the portion (i) has a length (d) in the longitudinal direction, the tapered portion (ii) has a length (f), and the ratio of said length (f) to said length (d) is in the range of 0.3 to 0.6.

47. A substrate according to claim 41, wherein the substrate has a central portion with a thickness (a), the portion (i) has a thickness (c), and the ratio of said thickness (c) to said thickness (a) is in the range of 0.5 to 0.8.

48. A substrate according to claim 44, wherein the substrate has a central portion with a thickness (a), the portion (i) has a thickness (c), and the ratio of said thickness (c) to said thickness (a) is in the range of 0.5 to 0.8.

49. A substrate according to claim 45, wherein the substrate has a central portion with a thickness (a), the portion (i) has a thickness (c), and the ratio of said thickness (c) to said thickness (a) is in the range of 0.5 to 0.8.

50. A substrate according to claim 47, wherein the thickness (c) is a maximum thickness of a central portion of the portion (i) in the longitudinal direction.

51. A substrate according to claim 41, wherein the substrate has a central portion with a thickness of 3 mm or less.

52. A substrate according to claim 47, wherein the thickness (a) is 3 mm or less.

53. A substrate according to claim 48, wherein the thickness (a) is 3 mm or less.

54. A substrate according to claim 49, wherein the thickness (a) is 3 mm or less.

55. A substrate according to claim 41, wherein the substrate is constituted by an aluminum material or an aluminum alloy material.

56. An electrophotographic apparatus comprising:

a light receiving member comprising a substrate in a cylindrical form and a light receiving layer formed on said substrate, and a fixing member equipped in mesh with said drum-like shaped substrate on the side of at least an end portion of said drum-like shaped substrate for sustaining said drum-like shaped substrate, said light receiving member being made capable of being rotated by means of said fixing member, at least a charging means, a developing means and a transferring means which are provided about said light receiving member, a transporting mechanism for a transfer sheet onto which a developer is transferred, and an exposure means, wherein said substrate has (i) a portion whose bore is enlarged on the side of at least an end portion of said substrate and (ii) a tapered portion having a thickness which is gradually thinned than that of said portion (i) in a direction toward said end portion of said substrate, and said fixing member is provided in contact with said portion (i).

57. An electrophotographic apparatus according to claim 56, wherein the position of the fixing member is regulated in an end face of the substrate.

58. An electrophotographic apparatus according to claim 56, wherein the position of the fixing member is regulated by means of a step in an enlarged region of the portion (i).

59. An electrophotographic apparatus according to claim 56 which further comprises a fixing member for retaining the substrate which is provided at the remaining end portion of the substrate, wherein the two fixing members have the same or a different configuration.

60. An electrophotographic apparatus according to claim 56, wherein the portion (i) has a thickness (c), the tapered portion (ii) has a minimum thickness (e), and the ratio of said minimum thickness (e) to said thickness (c) is in the range of 0.47 to 0.96.

61. An electrophotographic apparatus according to claim 60, wherein the thickness (c) is a maximum thickness of a central portion of the portion (i) in the longitudinal direction.

62. An electrophotographic apparatus according to claim 56, wherein the tapered portion (ii) has a length (f), the portion (i) has a length (d) in the longitudinal direction, and the ratio of said length (f) to said length (d) is in the range of 0.3 to 0.6.

63. An electrophotographic apparatus according to claim 60, wherein the portion (i) has a length (d) in the longitudinal direction, the tapered portion (ii) has a length (f), and the ratio of said length (f) to said length (d) is in the range of 0.3 to 0.6.

64. An electrophotographic apparatus according to claim 61, wherein the portion (i) has a length (d) in the longitudinal direction, the tapered portion (ii) has a length (f), and the ratio of said length (f) to said length (d) is in the range of 0.3 to 0.6.

65. An electrophotographic apparatus according to claim 56, wherein the substrate has a central portion with a thickness (a), the portion (i) has a thickness (c), and the ratio of said thickness (c) to said thickness (a) is in the range of 0.5 to 0.8.

66. An electrophotographic apparatus according to claim 63, wherein the substrate has a central portion with a thickness (a), the portion (i) has a thickness (c), and the ratio of said thickness (c) to said thickness (a) is in the range of 0.5 to 0.8.

67. An electrophotographic apparatus according to claim 63, wherein the substrate has a central portion with a thickness (a), the portion (i) has a thickness (c), and the ratio of said thickness (c) to said thickness (a) is in the range of 0.5 to 0.8.

68. An electrophotographic apparatus according to claim 65, wherein the thickness (c) is a maximum thickness of a central portion of the portion (i) in the longitudinal direction.

69. An electrophotographic apparatus according to claim 56, wherein the substrate has a central portion with a thickness of 3 mm or less.

70. An electrophotographic apparatus according to claim 65, wherein the thickness (a) is 3 mm or less.

71. An electrophotographic apparatus according to claim 66, wherein the thickness (a) is 3 mm or less.

72. An electrophotographic apparatus according to claim 67, wherein the thickness (a) is 3 mm or less.

73. An electrophotographic apparatus according to claim 56, wherein the light receiving layer comprises an amorphous material containing silicon atoms as a matrix.

74. An electrophotographic apparatus according to claim 56, wherein the substrate is constituted by a metallic material.

75. An electrophotographic apparatus according to claim 56, wherein the substrate is constituted by an aluminum material or an aluminum alloy material.

76. An electrophotographic apparatus according to claim 56, wherein the light receiving layer comprises a layer formed by a manner of heating the substrate.

77. An electrophotographic apparatus according to claim 56 which further comprises a fixing means for fixing the developer transferred on the transfer sheet.

78. An electrophotographic apparatus according to claim 56 which further comprises a cleaning means for cleaning the light receiving member.

79. An electrophotographic apparatus according to claim 56, wherein the fixing member is configured such that it has at least a portion (X) capable of maintaining a fittingness precision with a face other than the tapered portion (ii), a portion (Y) having a face to be contacted with the end portion of the substrate and a non-contacting portion (Z) between said portions (X) and (Y) so as to satisfy the following equation $Z<X<Y$.

80. An electrophotographic apparatus including a light receiving member comprising a substrate in a cylindrical form and a light receiving layer formed on said substrate, wherein said substrate has (i) a portion whose bore is enlarged on the side of said end portion of said substrate and (ii) a tapered portion which is situated next to and outside said portion (i).

81. An electrophotographic apparatus according to claim 80, wherein the light receiving layer comprises an amorphous material containing silicon atoms as a matrix.

82. An electrophotographic apparatus according to claim 80, wherein the substrate is constituted by a metallic material.

* * * * *

UNITED STATES PATENT AND TRADEMARK OFFICE

CERTIFICATE OF CORRECTION

PATENT NO. : 5,853,936
DATED : December 29, 1998
INVENTOR(S) : Yoshio Segi et al.

It is certified that error appears in the above-identified patent and that said Letters Patent is hereby corrected as shown below:

Column 1,
Line 11, "such" (second occurrence) should be deleted.

Column 2,
Line 3, "and" (second occurrence) should be deleted.

Column 3,
Line 15, "course" should read -- course, --;
Line 23, "as" should should be deleted.

Column 4,
Line 24, "polarity.) A transfer" should read -- polarity.) ¶ A transfer --.

Column 5,
Line 2, "above described" should read -- above-described --;
Line 10, "occurrence" should read -- occurrence of --.

Column 6,
Line 5, "are" should be deleted.

Column 8,
Line 25, "be occurred." should read -- occur. --.

Column 11,
Line 49, ".prob-" should read -- prob --.

Column 12,
Line 39, "apparatus" should read -- apparatus. --.

Column 13,
Line 12, "portion" should read -- portion. --.

Column 16,
Line 56, "the" (second occurrence) should be deleted;
Line 62, "5.0 mm" should read -- 5.0 mm. --.

Column 17,
Line 3, "shown" (second ocurrence) should be deleted.

UNITED STATES PATENT AND TRADEMARK OFFICE

CERTIFICATE OF CORRECTION

PATENT NO. : 5,853,936
DATED : December 29, 1998
INVENTOR(S) : Yoshio Segi et al.

It is certified that error appears in the above-identified patent and that said Letters Patent is hereby corrected as shown below:

Column 18,
Line 48, "therms" should read -- terms --;
Line 50, "3.0 mmm." should read -- 3.0 mm. --;
Line 56, "be entail" should read -- occur --.

Column 19,
Line 3, "the" (second occurrence) should be deleted;
Line 7, "the" (second occurrence) should be deleted.

Column 21,
Line 45, "electrophptographic" should read -- electrophotographic --.

Column 22,
Line 23, "shown" (second occurrence) should be deleted;
Line 63, "to entail" should read -- to occur --; and "a" (second occurrence) should read -- an --.

Column 24,
Line 28, "shown" (second occurrence) should be deleted;
Line 29, close up right margin;
Line 30, close up left margin.

Column 25,
Line 3, "conf iguration" should read -- configuration --;
Line 5, "the" (second occurrence) should be deleted;
Line 9, "the" (second occurrence) should be deleted;
Line 30, "shown" (second occurrence) should be deleted;
Line 43, "to The" should read -- to (3). The --.

Column 27,
Line 18, "shown" should read -- shown in --;
Line 58, "phptographic" should read -- photographic --.

Column 28,
Line 12, "end" should read -- and --;
Line 26, "shown shown" should read -- shown --;
Line 67, "to entail" should read -- to occur --.

Column 29,
Line 1, "a image" should read -- an image --.

UNITED STATES PATENT AND TRADEMARK OFFICE

CERTIFICATE OF CORRECTION

PATENT NO. : 5,853,936
DATED : December 29, 1998
INVENTOR(S) : Yoshio Segi et al.

It is certified that error appears in the above-identified patent and that said Letters Patent is hereby corrected as shown below:

Column 30,
Line 24, "there" (first occurrence) should read -- these --;
Line 33, "shown shown" should read -- shown --;
Line 54, "there" should read -- these --;
Line 63, "shown shown" should read -- shown --.

Column 31,
Line 26, "shown shown" should read -- shown --;
Line 46, "there" (first occurrence) should read -- these --;
Line 55, "shown shown" should read -- shown --.

Column 32,
Line 12, "there" (first occurrence) should read -- these --;
Line 21, "shown shown" should read -- shown --;
Line 44, "there" should read -- these --;
Line 53, "shown shown" should read -- shown --.

Column 33,
Line 9, "there" (first occurrence) should read -- these --;
Line 18, "shown shown" should read -- shown --;
Line 43, "there" (first occurrence) should read -- these --.

Column 34,
Line 6, "shown shown" should read -- shown --;
Line 29, "an" should be deleted.

Signed and Sealed this

Twenty-third Day of October, 2001

*Attest:*

Nicholas P. Godici

*Attesting Officer*

NICHOLAS P. GODICI
*Acting Director of the United States Patent and Trademark Office*